US012055293B2

(12) United States Patent
Vukanti et al.

(10) Patent No.: US 12,055,293 B2
(45) Date of Patent: Aug. 6, 2024

(54) COMBUSTOR HAVING DILUTION COOLED LINER

(71) Applicant: General Electric Company, Schenectady, NY (US)

(72) Inventors: Perumallu Vukanti, Bengaluru (IN); Karthikeyan Sampath, Bengaluru (IN); Pradeep Naik, Bengaluru (IN); Ranganatha Narasimha Chiranthan, Bengaluru (IN); Rimple Rangrej, Bengaluru (IN); Hiranya Nath, Bengaluru (IN); Ravindra Shankar Ganiger, Bengaluru (IN)

(73) Assignee: GENERAL ELECTRIC COMPANY, Cincinnati, OH (US)

( * ) Notice: Subject to any disclaimer, the term of this patent is extended or adjusted under 35 U.S.C. 154(b) by 0 days.

(21) Appl. No.: 17/932,806

(22) Filed: Sep. 16, 2022

(65) Prior Publication Data

US 2023/0383949 A1 Nov. 30, 2023

(30) Foreign Application Priority Data

May 24, 2022 (IN) ..... 202211029740

(51) Int. Cl.
*F23R 3/06* (2006.01)
*F23R 3/00* (2006.01)

(52) U.S. Cl.
CPC ..... *F23R 3/06* (2013.01); *F23R 3/002* (2013.01); *F23R 2900/00017* (2013.01); *F23R 2900/03042* (2013.01)

(58) Field of Classification Search
CPC .. F23R 3/002; F23R 3/045; F23R 3/06; F23R 3/16; F23R 3/44; F23R 3/46; F23R 3/50; F23R 3/52; F23R 3/54; F23R 2900/00017; F23R 2900/03042
See application file for complete search history.

(56) References Cited

U.S. PATENT DOCUMENTS

| | | | | |
|---|---|---|---|---|
| 4,773,227 | A * | 9/1988 | Chabis | F23R 3/045 60/757 |
| 5,483,794 | A | 1/1996 | Nicoll et al. | |
| 6,484,505 | B1 | 11/2002 | Brown et al. | |
| 8,291,711 | B2 | 10/2012 | Chokshi et al. | |
| 10,113,745 | B2 | 10/2018 | Torkaman et al. | |

(Continued)

*Primary Examiner* — Scott J Walthour
(74) *Attorney, Agent, or Firm* — Venable LLP; Griffin A. A. Deadwick; Michele V. Frank

(57) ABSTRACT

A combustor for a gas turbine has a combustor liner including an upstream liner portion, and a downstream liner portion. The upstream liner portion includes an outer shell and a heat shield panel, with a baffle cavity therebetween. The outer shell includes an outer shell cooling opening for providing a flow of compressed air to the baffle cavity, and the heat shield panel includes a heat shield panel cooling opening at a downstream end of the heat shield panel. A fence is arranged at a downstream side of the heat shield panel cooling opening and extends beyond a hot side surface of the heat shield panel into a combustion chamber. The heat shield panel cooling opening provides a flow of the compressed air therethrough from the baffle cavity for cooling of the heat shield panel and for providing at least partial dilution of combustion gases within the combustion chamber.

18 Claims, 10 Drawing Sheets

(56) References Cited

U.S. PATENT DOCUMENTS 10,598,382 B2 3/2020 Tu et al.
10,739,001 B2 8/2020 Burd
11,092,339 B2 8/2021 Moura et al.
11,549,686 B2 * 1/2023 Gandikota ..... F23R 3/002
11,572,835 B2 * 2/2023 Gandikota ..... F23R 3/60
11,578,868 B1 * 2/2023 Chakraborty ..... F23R 3/26
11,725,817 B2 * 8/2023 Ganiger ..... F23R 3/50
60/752
11,754,284 B2 * 9/2023 Naik ..... F23R 3/005
60/752
11,774,098 B2 * 10/2023 Naik ..... F23R 3/50
60/752
11,885,495 B2 * 1/2024 Ganiger ..... F02C 3/00
2003/0213250 A1 * 11/2003 Pacheco-Tougas ..... F23R 3/60
60/752
2004/0261419 A1 * 12/2004 McCaffrey ..... F23M 5/04
60/752
2013/0327049 A1 * 12/2013 Cunha ..... F23R 3/007
60/754
2013/0327056 A1 * 12/2013 Cunha ..... F23R 3/002
60/754
2014/0033723 A1 * 2/2014 Doerr ..... F23R 3/045
60/737
2016/0209033 A1 7/2016 Burd
2016/0238253 A1 * 8/2016 Moura ..... F23R 3/002
2017/0307217 A1 * 10/2017 Clemen ..... F23R 3/002
2018/0306113 A1 10/2018 Morton et al.
2019/0093892 A1 * 3/2019 Rimmer ..... F23R 3/10
2019/0195496 A1 6/2019 Moura et al.
2019/0368736 A1 * 12/2019 Rudrapatna ..... F23R 3/045
2022/0282867 A1 * 9/2022 Gandikota ..... F23R 3/16
2022/0364510 A1 * 11/2022 Gandikota ..... F23R 3/50
2022/0390110 A1 * 12/2022 Naik ..... F23R 3/60
2022/0390111 A1 * 12/2022 Ganiger ..... F23R 3/002
2022/0390112 A1 * 12/2022 Ganiger ..... F23R 3/002
2022/0390113 A1 * 12/2022 Ganiger ..... F23R 3/06
2022/0390114 A1 * 12/2022 Ganiger ..... F23R 3/50
2022/0390115 A1 * 12/2022 Sampath ..... F23R 3/002
2023/0003382 A1 * 1/2023 Ganiger ..... F23R 3/60
2023/0094199 A1 * 3/2023 Naik ..... F23R 3/06
60/752
2023/0137910 A1 * 5/2023 Singh ..... F23R 3/50
60/752
2023/0146319 A1 * 5/2023 Naik ..... F23R 3/16
60/752

* cited by examiner

COMBUSTOR HAVING DILUTION COOLED LINER

CROSS REFERENCE TO RELATED APPLICATIONS

The present application claims the benefit of Indian Patent Application No. 202211029740, filed on May 24, 2022, which is hereby incorporated by reference herein in its entirety.

TECHNICAL FIELD

The present disclosure relates to cooling of heat shield panels in multi-layer combustor liners.

BACKGROUND

Some gas turbine engines include a combustor that has a multi-layer liner formed by an outer shell and a plurality of heat shield panels connected internally of the outer shell. The multi-layer liner may define a forward portion closest to a dome having mixer assemblies therein, and an aft portion downstream of the forward portion. Cooling airflow holes may be included in the outer shell to allow a flow of cooling air to pass therethrough, and the heat shield panels may include cooling holes to provide a film cooling to the surface of the heat shield panels.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
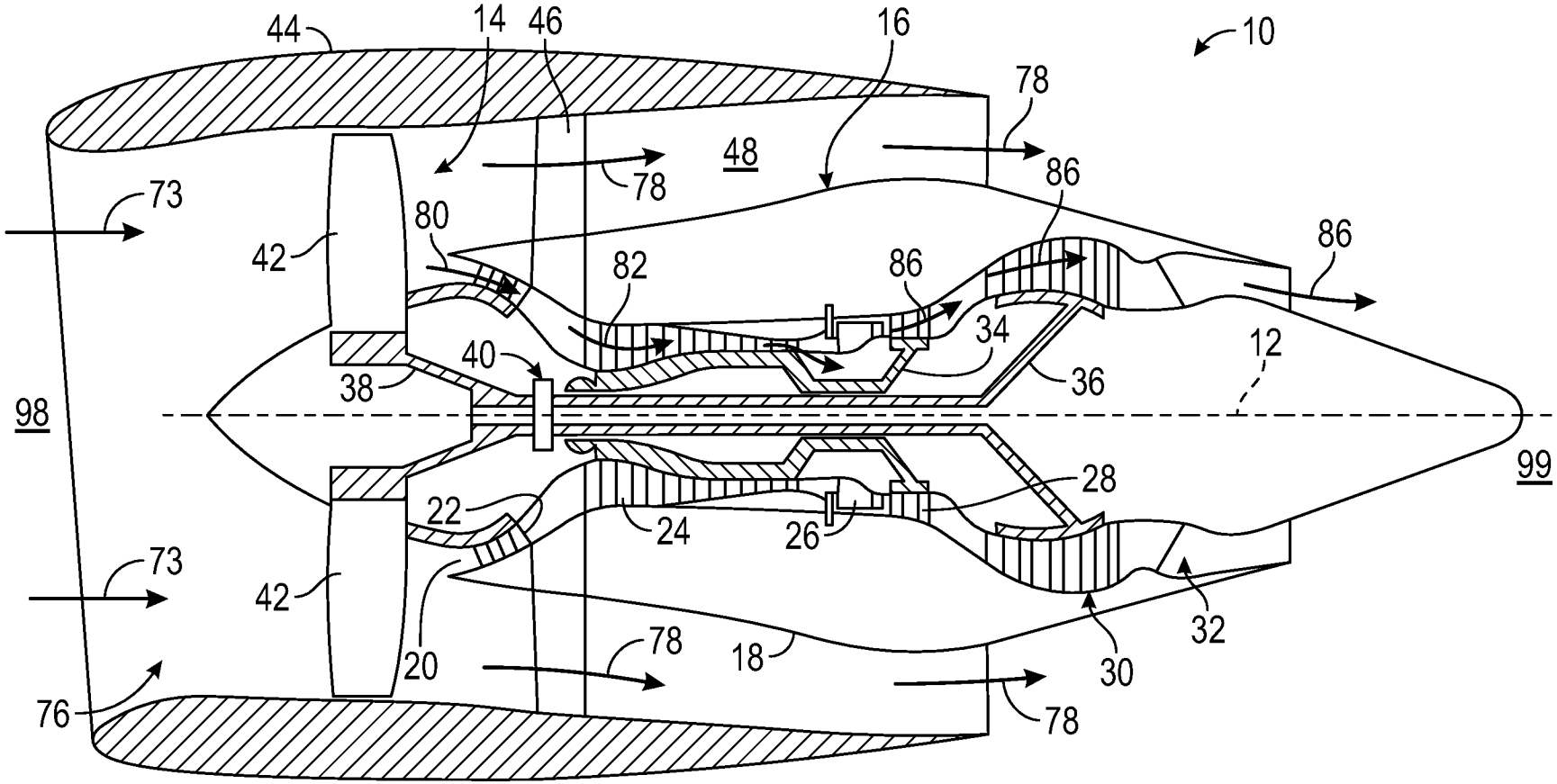
FIG. 1 is a schematic partial cross-sectional side view of an exemplary high bypass turbofan jet engine, according to an aspect of the present disclosure.

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first" or "second" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Some gas turbine engines include a combustor having a dome and mixer assemblies arranged through the dome, with deflectors arranged on a combustion chamber side of the dome around the mixer assemblies. The combustor also includes a combustor liner and may include a multi-layer liner formed by an outer shell and a plurality of heat shield panels connected internally of the outer shell. The multi-layer liner may define a forward portion closest to a dome, and an aft portion downstream of the forward portion. Cooling airflow holes may be included in the outer shell to allow a flow of cooling air to pass therethrough, and the heat shield panels may include film cooling holes to provide a flow of film cooling air to a surface of the heat shield panels. Compressed air from a compressor is provided to the combustor and is utilized for mixing with a fuel for combustion, for providing cooling to the combustor, and for providing dilution to combustion gases within the combustor. A conventional combustor may be configured such that about thirty percent of the total airflow through the combustor is provided to the dome and mixer assemblies for mixing with fuel and for cooling of the dome and deflectors, about twenty percent of the total combustor airflow is utilized for cooling of the combustor liner, and the remaining fifty percent of the total combustor airflow is utilized for dilution of the combustion gases. In the multi-layer liner configuration having the outer shell and the heat shield panels, the heat shield panels, and especially those on the forward portion of the liner, are subject to intense heat from the combustion gases and, while the film cooling may provide some relief from the heat to the heat shield panels, over time, the heat shield panels can deteriorate and require replacement.

The present disclosure provides a technique for increasing the cooling of the liner, and in particular, cooling of the heat shield panels on the forward portion of the multi-layer liner that may be subject to the most intense heat. Such hot spots may occur, for example, at a transition between the forward liner portion and the aft liner portion. According to the present disclosure, the outer shell may include cooling openings therethrough in the upstream portion of the outer shell to utilize a portion of the dilution air for cooling of the liner. The upstream portion also includes at least one cooling opening at a downstream end of the heat shield panels through which the cooling air (i.e., the portion of the dilution air) passes for cooling of the hot spots. The cooling air passing through the cooling openings in the heat shield panels is sufficient enough so that it may also be utilized to both cool the liner, and to provide some dilution of the combustion gases. That is, the cooling opening in the heat shield panel may be larger than typical film cooling holes so as to provide a sufficient amount of airflow therethrough that can both cool the heat shield panel and may also provide at least some dilution of the combustion gases. For example, a slotted cooling opening may be implemented to provide a greater airflow therethrough as compared to typical film cooling holes, and to provide a better lateral spread of the cooling air within the combustion chamber. In addition, a fence may be implemented at a downstream side of the slotted cooling opening so as to provide deeper penetration of the cooling air into the combustion chamber to provide at least some dilution of the combustion gases. The slotted cooling opening and the fence may also provide protection to the transition between the upstream heat shield panel and a downstream heat shield panel. As a result, the present disclosure may provide as much as seventy percent of the total combustor airflow for cooling of the combustor, while maintaining at least some dilution of the combustion gases.

Referring now to the drawings, FIG. 1 is a schematic partial cross-sectional side view of an exemplary high bypass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine-based turbine engines, industrial turbine engines, and auxiliary power units. As shown in FIG. 1, the engine 10 has an axial centerline axis 12 that extends therethrough from an upstream end 98 to a downstream end 99 for reference purposes. In general, the engine 10 may include a fan assembly 14 and a core engine 16 disposed downstream from the fan assembly 14.

The core engine 16 may generally include an outer casing 18 that defines an annular inlet 20. The outer casing 18 encases, or at least partially forms, in serial flow relationship, a compressor section (22/24) having a low pressure (LP) compressor 22 and a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration.

As shown in FIG. 1, the fan assembly 14 includes a plurality of fan blades 42 that are coupled to, and that extend radially outwardly from, the fan shaft 38. An annular fan casing or a nacelle 44 circumferentially surrounds the fan assembly 14 and/or at least a portion of the core engine 16. The nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
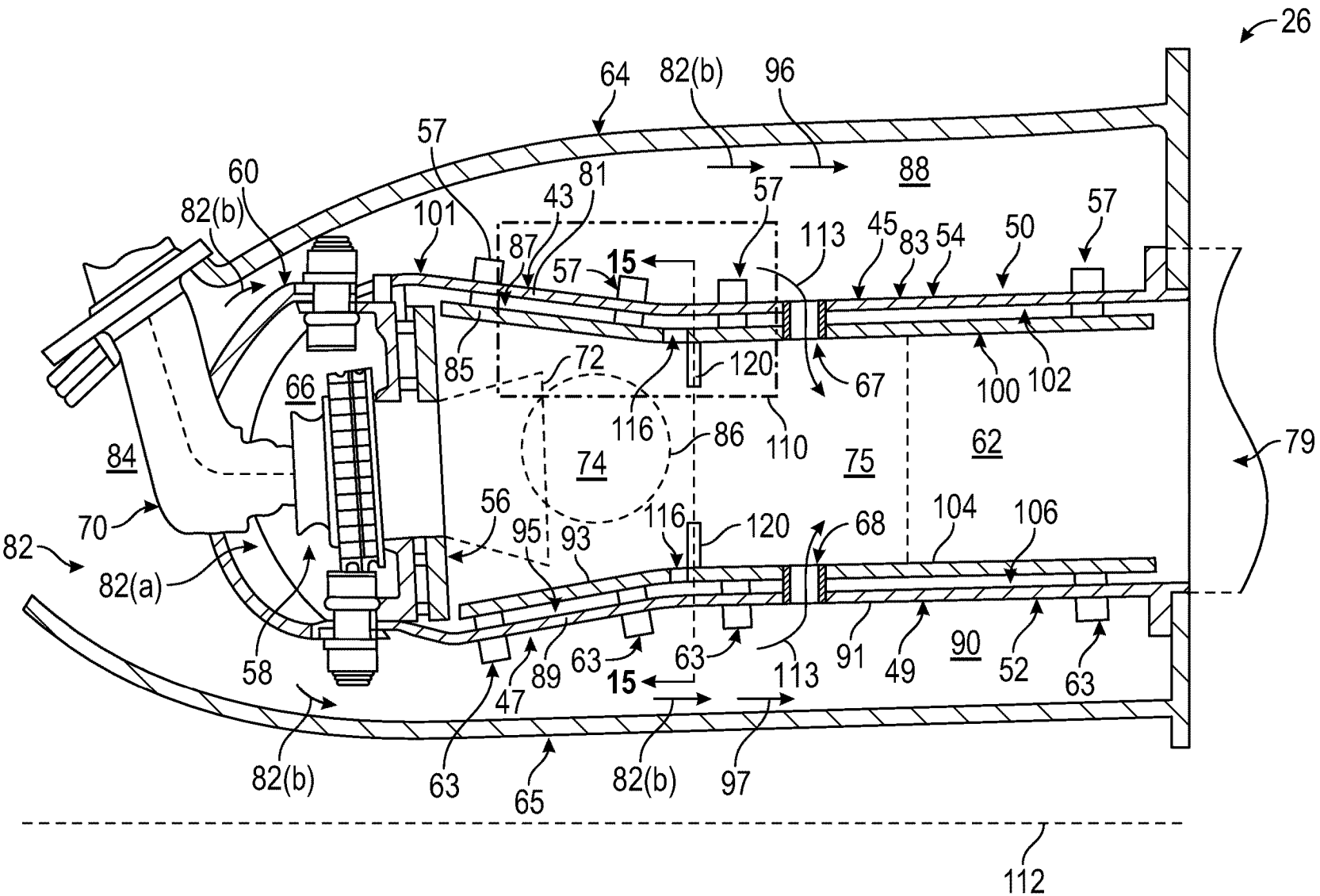
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. As shown in FIG. 2, the combustor 26 may generally include a combustor liner 50 having an inner liner 52 and an outer liner 54, and a dome assembly 56 arranged at an upstream end 101 of the combustor liner 50, together defining a combustion chamber 62. Both the inner liner 52 and the outer liner 54 may extend circumferentially about a combustor centerline axis 112, which may correspond to the engine axial centerline axis 12 (FIG. 1). The inner liner 52 and the outer liner 54 are connected to a cowl 60, and a pressure plenum 66 is defined between the cowl 60, the inner liner 52, the outer liner 54, and the dome assembly 56. The combustor 26 also includes a mixer assembly 58 that is connected to a fuel nozzle assembly 70. While FIG. 2 depicts a single mixer assembly 58 and a single fuel nozzle assembly 70, a plurality of mixer assemblies 58 and respective fuel nozzle assemblies 70 may be included in the combustor 26, where each respective mixer assembly 58 and fuel nozzle assembly 70 is circumferentially spaced about the combustor centerline axis 112.

As shown in FIG. 2, the inner liner 52 is encased within an inner casing 65 and the outer liner 54 is encased within an outer casing 64. An outer flow passage 88 is defined between the outer liner 54 and the outer casing 64, and an inner flow passage 90 is defined between inner liner 52 and the inner casing 65. Both the outer casing 64 and the inner casing 65 may extend circumferentially about the combustor centerline axis 112. The inner liner 52 and the outer liner 54 may extend from the dome assembly 56 to a turbine nozzle 79 at an entry to the HP turbine 28 (FIG. 1), thus at least partially defining a hot gas path between the combustor liner 50 and the HP turbine 28. The combustion chamber 62 may more specifically define a primary combustion zone 74 at which an initial chemical reaction of a fuel-oxidizer mixture 72 occurs to generate combustion gases 86, and/or where recirculation of the combustion gases 86 may occur before the combustion gases 86 flow further downstream within the combustion chamber 62 to a dilution zone 75 and then into the turbine nozzle 79 at the entry to the HP turbine 28 and the LP turbine 30 (FIG. 1).

The outer liner 54 may include an upstream liner portion 43 and a downstream liner portion 45, and the inner liner 52 may include an upstream liner portion 47 and a downstream liner portion 49. The upstream liner portion 43 of the outer liner 54 includes an upstream liner outer shell 81 and the downstream liner portion 45 includes a downstream liner outer shell 83. Both the upstream liner outer shell 81 and the downstream liner outer shell 83 may extend circumferentially about the combustor centerline axis 112. The upstream liner outer shell 81 and the downstream liner outer shell 83 may be formed as separate shells that may be joined together, or they may be integral with one another so as to be formed as a continuous unit. The upstream liner portion 43 includes at least one upstream liner heat shield panel 85 connected to the upstream liner outer shell 81 by shell-to-panel connecting members 57 so as to define an upstream liner baffle cavity 87 between the upstream liner outer shell 81 and the upstream liner heat shield panel 85. As will be described below, a plurality of upstream liner heat shield panels 85 may be connected circumferentially about the combustor centerline axis 112 to the upstream liner outer shell 81. Similarly, the upstream liner portion 47 of the inner liner 52 includes an upstream liner outer shell 89 and the downstream liner portion 49 includes a downstream liner outer shell 91. Both the upstream liner outer shell 89 and the downstream liner outer shell 91 may extend circumferentially about the combustor centerline axis 112. The upstream liner outer shell 89 and the downstream liner outer shell 91 may be formed as separate shells that may be joined together, or they may be formed integral with one another so as to be formed as a continuous unit. The upstream liner portion 47 includes at least one upstream liner heat shield panel 93 connected to the upstream liner outer shell 89 by shell-to-panel connecting members 63 so as to define an upstream liner baffle cavity 95 between the upstream liner outer shell 89 and the upstream liner heat shield panel 93. Similar to the upstream liner portion 43 of the outer liner 54, a plurality of upstream liner heat shield panels 93 may be connected circumferentially about the combustor centerline axis 112 to the upstream liner outer shell 89.

The downstream liner portion 45 of the outer liner 54 includes at least one downstream liner heat shield panel 100 connected to the downstream liner outer shell 83 via the shell-to-panel connecting members 57 so as to define a downstream liner baffle cavity 102 between the downstream liner outer shell 83 and the downstream liner heat shield panel 100. Similar to the upstream liner portion 43, a plurality of the downstream liner heat shield panels 100 may be circumferentially connected to the downstream liner outer shell 83. Similarly, the downstream liner portion 49 of the inner liner 52 includes at least one downstream liner heat shield panel 104 connected to the downstream liner outer shell 91 via the shell-to-panel connecting members 63 so as to define a downstream liner baffle cavity 106 therebetween. Similar to the downstream liner portion 45 of the outer liner 54, the downstream liner portion 49 of the inner liner 52 may include a plurality of the downstream liner heat shield panels 104 circumferentially connected to the downstream liner outer shell 91. The downstream liner portion 45 of the outer liner 54 may also include at least one outer liner dilution opening 67 therethrough, and the downstream liner portion 49 of the inner liner 52 may also include at least one inner liner dilution opening 68 therethrough. The outer liner dilution opening 67, if included, provides a dilution jet flow 113 of dilution air to flow from the outer flow passage 88 into the dilution zone 75 of the combustion chamber 62, and the inner liner dilution opening 68, if included, provides a dilution jet flow 113 of dilution air to flow from the inner flow passage 90 into the dilution zone 75 of the combustion chamber 62. The at least one outer liner dilution opening 67, if included, may include a plurality of circumferentially spaced outer liner dilution openings 67 about the downstream liner portion 45 of the outer liner 54. Similarly, the at least one inner liner dilution opening 68, if included, may include a plurality of inner liner dilution openings 68 circumferentially spaced about the downstream liner portion 49 of the inner liner 52.

During operation of the engine 10, as shown in FIGS. 1 and 2 collectively, a volume of air, as indicated schematically by arrows 73, enters the engine 10 from the upstream end 98 through an associated nacelle inlet 76 of the nacelle 44 and/or the fan assembly 14. As the air 73 passes across the fan blades 42, a portion of the air 73 is directed or routed into the bypass airflow passage 48 as a bypass airflow 78, while another portion of the air 73 is directed or routed into the LP compressor 22 as a compressor inlet air 80. The compressor inlet air 80 is progressively compressed as it flows through the LP compressor 22 and the HP compressor 24 towards the combustor 26. As shown in FIG. 2, compressed air 82 flows into and pressurizes a diffuser cavity 84. A first portion of the compressed air 82, as indicated schematically by arrows 82(*a*), flows from the diffuser cavity 84 into the pressure plenum 66, where it is mixed by mixer assembly 58 with fuel provided by the fuel nozzle assembly 70. The fuel-oxidizer mixture 72 is then ejected into the combustion chamber 62 by the mixer assembly 58. The fuel-oxidizer mixture 72 is ignited and burned to generate the combustion gases 86 within the primary combustion zone 74 of the combustion chamber 62. Typically, the LP compressor 22 and the HP compressor 24 provide more compressed air 82 to the diffuser cavity 84 than is needed for combustion. Therefore, a second portion of the compressed air 82, as indicated schematically by arrows 82(*b*), may be used for various purposes other than combustion. For example, as shown in FIG. 2, compressed air 82(*b*) may be routed into the outer flow passage 88, where the compressed air 82(*b*) flows in a downstream flow direction 96 within the outer flow passage 88. Another portion of the compressed air 82(*b*) may be routed into the inner flow passage 90, where the compressed air 82(*b*) flows in a downstream flow direction 97 in the inner flow passage 90. A portion of the compressed air 82(*b*) within the outer flow passage 88 may be utilized as the dilution jet flow 113 of the dilution air flowing through the at least one outer liner dilution opening 67, and a portion of the compressed air 82(*b*) within the inner flow passage 90 may be utilized as the dilution jet flow of dilution air flowing through the at least one inner liner dilution opening 68. In addition, or in the alternative, as will be described below, at least a portion of the compressed air 82(*b*) may be utilized for cooling of the upstream liner heat shield panel 85, the downstream liner heat shield panel 100, the upstream liner heat shield panel 93, and the downstream liner heat shield panel 104, or may be routed out of the diffuser cavity 84 for other purposes, such as to provide cooling air to at least one of the HP turbine 28 or the LP turbine 30.

Referring back to FIGS. 1 and 2 collectively, the combustion gases 86 generated in the combustion chamber 62 flow through the turbine nozzle 79 and into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at the downstream end 99.

Figure 3:
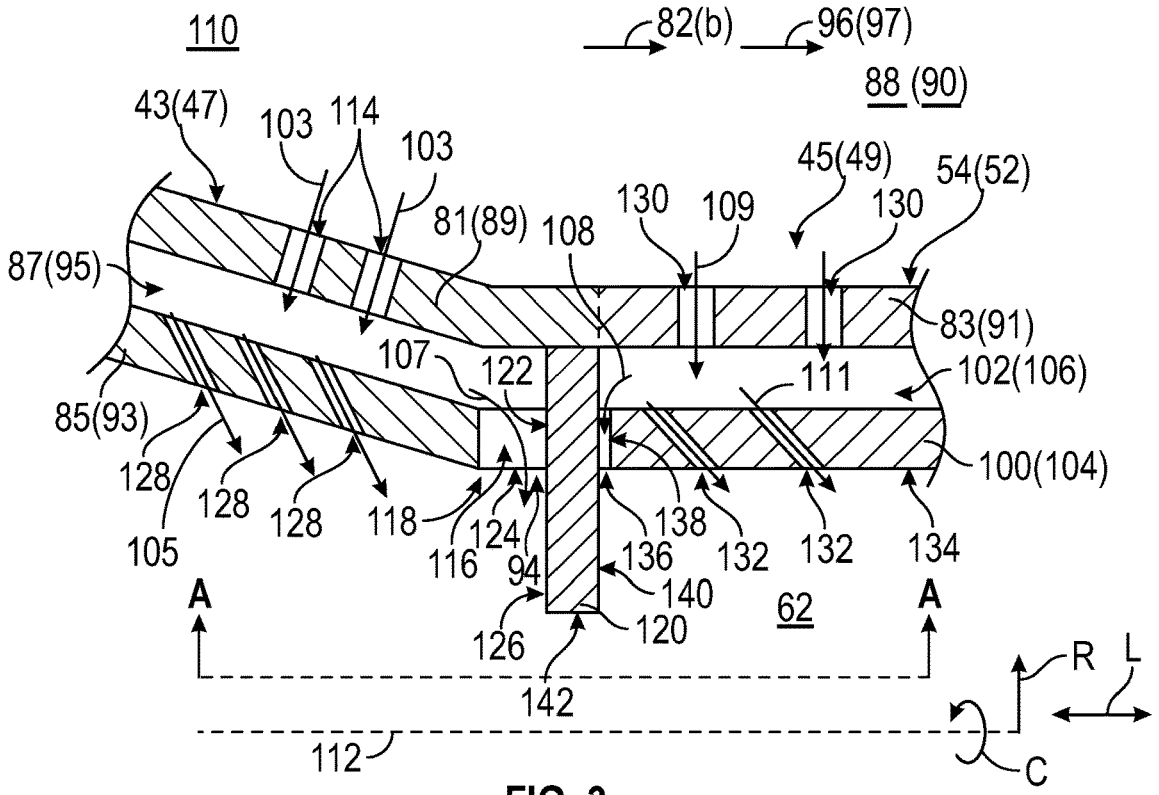
FIG. 3 is a cross-sectional enlarged view taken at detail view 110 of FIG. 2 of an upstream liner portion, according to an aspect of the present disclosure.

FIG. 3 is a cross-sectional enlarged view taken at detail view 110 of FIG. 2 of the upstream liner portion 43 and an upstream end of the downstream liner portion 45, according to an aspect of the present disclosure. While the following description will be made with regard to the upstream liner portion 43 and the downstream liner portion 45 of the outer liner 54, the following description is equally applicable to the upstream liner portion 47 and the downstream liner portion 49 of the inner liner 52 and, therefore, in some instances, references to elements of the inner liner 52 may be provided in the figures with parentheses. In FIG. 3, the shell-to-panel connecting members 57 (FIG. 2) are not shown. The upstream liner outer shell 81 is seen to include at least one upstream liner outer shell cooling opening 114 for providing an airflow 103 of a portion of the compressed air 82(*b*) from the outer flow passage 88 therethrough into the upstream liner baffle cavity 87. Each of the upstream liner outer shell cooling openings 114 are generally greater in size or greater in number, or both, than cooling passages 130 (described below) so as to provide a sufficient airflow into the upstream liner baffle cavity 87 to cool the heat shield panel 85 and for providing at least some dilution to the combustion gases 86 within the combustion chamber 62. In addition, the upstream liner outer shell cooling openings 114 are generally smaller in size than the outer liner dilution opening 67. Thus, the upstream liner outer shell cooling openings 114 are implemented to provide the airflow 113 as a portion of the compressed air 82(*b*) for cooling of the upstream liner heat shield panel 85, as will be described below.

The upstream liner heat shield panel 85 includes at least one heat shield panel cooling opening 116 therethrough at a downstream end 118 of the upstream liner heat shield panel 85. At least one fence 120 is arranged at a downstream side 122 of the heat shield panel cooling opening 116. The fence 120 extends beyond a hot side surface 124 of the upstream liner heat shield panel 85 into the combustion chamber 62. The fence 120 is shown in FIG. 3 as being connected with the upstream liner outer shell 81. However, as will be described in more detail below, the fence 120 may be connected to any of the upstream liner outer shell 81, the downstream liner outer shell 83, the upstream liner heat shield panel 85, or to the downstream liner heat shield panel 100. The compressed air from the airflow 103 within the upstream liner baffle cavity 87 flows through the at least one heat shield panel cooling opening 116 as an airflow 107, along an upstream side 126 of the fence 120 and into the combustion chamber 62, thereby providing cooling to the upstream liner heat shield panel 85 at a gap 94 with the downstream liner heat shield panel 100. The upstream liner heat shield panel 85 may also include one or more cooling passages 128 upstream of the heat shield panel cooling opening 116 to provide an airflow 105 from the upstream liner baffle cavity 87 to be used for film cooling of the hot side surface 124 of the upstream liner heat shield panel 85. Here, the airflow 105 through the cooling passages 128 merely provides for film cooling of the hot side surface 124 of the heat shield panel 85, while the airflow 107 may be a flow of air having a sufficient velocity and a sufficient volume to penetrate deeper into the combustion chamber 62 away from the hot side surface 124 of the heat shield panel 85. As a result, the airflow 107 may be more closely related to the dilution jet flow 113 through the outer liner dilution opening 67 (FIG. 2) in that the airflow 107 may also provide at least some dilution of the combustion gases 86 upstream of the dilution zone 75, while at the same time, providing cooling to the heat shield panel 85. Thus, the arrangement (i.e., the size and the number) of the upstream liner outer shell cooling openings 114, the cooling passages 128, and the heat shield panel cooling openings 116 may be such that the amount of the total combustor airflow through the combustor 26 (FIG. 2) that is utilized for cooling of the combustor liner 50 (FIG. 2) may be up to as much as seventy percent of the total combustor airflow. Of course, the arrangement of the upstream liner outer shell cooling openings 114, the cooling openings 128, and the heat shield panel cooling openings 116 may be such that about fifty percent of the total combustor airflow is utilized for cooling, while about twenty percent of the total combustor airflow is utilized for dilution via the outer liner dilution openings 67 (FIG. 2) and the inner liner dilution openings 68 (FIG. 2), and the remaining thirty percent of the total combustor airflow is utilized by the mixer assembly 58 (FIG. 2) and the dome assembly 56 (FIG. 2).

As shown in FIG. 3, the downstream liner outer shell 83 may include a plurality of cooling passages 130 therethrough to provide an airflow 109 of the compressed air 82(*b*) from the outer flow passage 88 to the downstream liner baffle cavity 102 to be used for film cooling of the downstream liner heat shield panel 100. The downstream liner heat shield panel 100 may also include a plurality of cooling passages 132 therethrough. The cooling passages 132 may provide an airflow 111 of the compressed air from the downstream liner baffle cavity 102 for film cooling of a hot side surface 134 of the downstream liner heat shield panel 100. In addition, a leakage cooling passage 136 may be included between an upstream end 138 of the downstream liner heat shield panel 100 and a downstream side 140 of the fence 120. The leakage cooling passage 136 may provide for an airflow 108 of the compressed air to flow from the downstream liner baffle cavity 102 along the downstream side 140 of the fence 120 so as to provide film cooling of the downstream side 140 of the fence 120. The airflow 108 of the compressed air along the downstream side 140 of the fence 120 may also prevent a wake from forming at an inner end 142 of the fence 120. While not shown in FIG. 3, the outer liner dilution opening 67 (FIG. 2) may be arranged downstream of the cooling passages 130.

Figure 4:
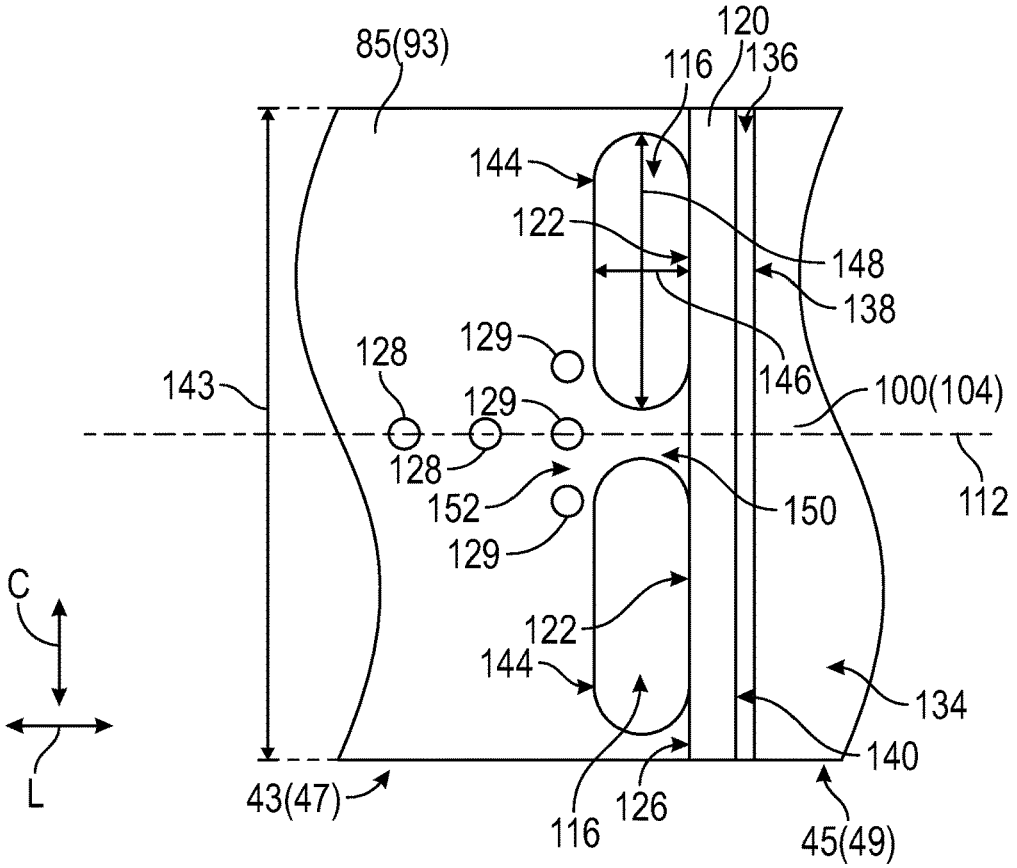
FIG. 4 is a plan view of a part of the upstream liner portion and the downstream liner portion taken at view A-A of FIG. 3, according to an aspect of the present disclosure.
Figure 5:
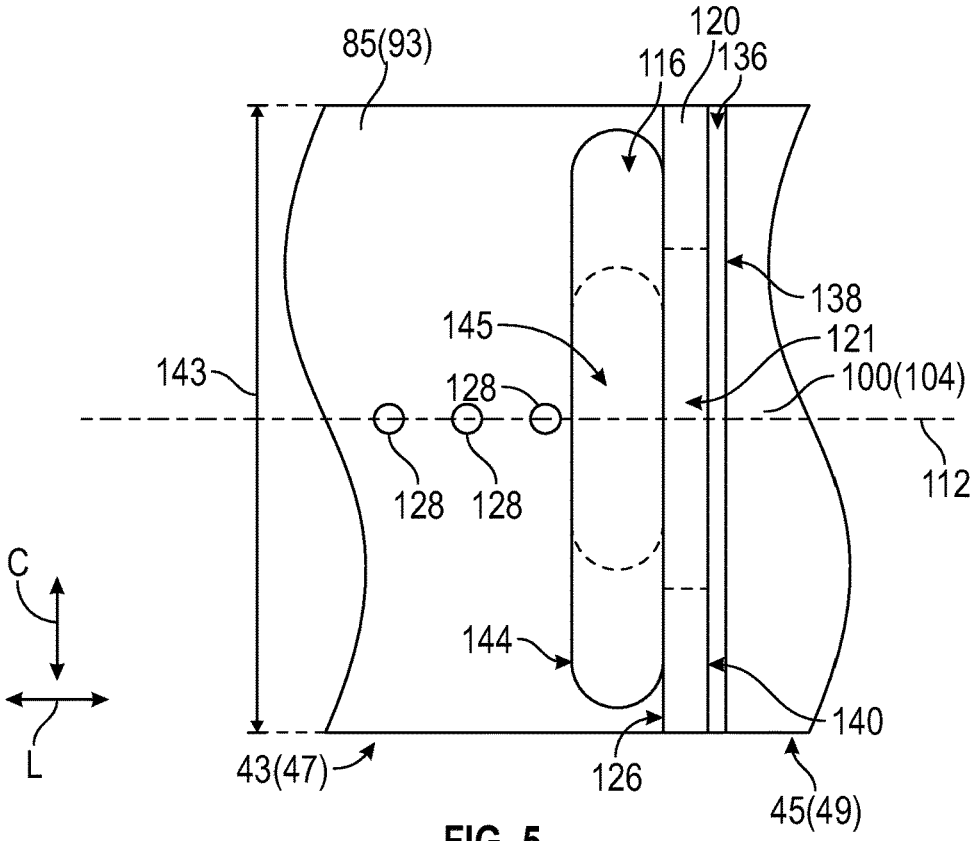
FIG. 5 is an alternate plan view of a part of the upstream liner portion and the downstream liner portion, according to an aspect of the present disclosure.

FIG. 4 is a plan view of a part of the upstream liner portion 43 and downstream liner portion 45 taken at view A-A of FIG. 3, according to an aspect of the present disclosure. As shown in FIG. 4, the upstream liner heat shield panel 85 may have a heat shield panel width 143 extending in a circumferential direction (C) with respect to the combustor centerline axis 112. The at least one heat shield panel cooling opening 116 is configured as a slotted cooling opening 144 extending in the circumferential direction (C) with respect to the combustor centerline axis 112. In the FIG. 4 aspect, two of the slotted cooling openings 144 are shown arranged adjacent to one another in the circumferential direction (C) across the heat shield panel width 143. Each of the slotted cooling openings 144 may have a slot width 146 extending in a longitudinal direction (L) with respect to the combustor centerline axis 112 and a slot length 148 in the circumferential direction (C). The slot width 146 and the slot length 148 may be configured to provide a desired amount of the airflow 107 (FIG. 3) therethrough. The slotted cooling openings 144 are not limited to two slotted cooling openings 144 extending across the heat shield panel width 143, and may include more than two slotted cooling openings 144. Alternatively, as shown in FIG. 5, which is an alternate arrangement of the plan view shown in FIG. 4, a single slotted cooling opening 144 may be included in the upstream liner heat shield panel 85, and may extend across the heat shield panel width 143. Of course, the single slotted cooling opening 144 may be formed of other shapes and need not be a slotted opening. For example, the single slotted cooling opening 144 may be a curved opening, a circular opening, or a hexagonal opening, as but a few examples. The fence 120 may also extend across the heat shield panel width 143 as seen in the plan view of FIG. 4. However, the fence 120 need not extend linearly in the circumferential direction, and the fence 120 may be curved, S-shaped, V-shaped, or any other shape. In another alternative arrangement shown in FIG. 5, a single slotted cooling opening 145 (shown with dashed lines) may extend partially across the heat shield panel width 143, and a fence 121 (shown with dashed lines) may also extend partially across the heat shield panel width 143.

Returning to FIG. 4, when more than one slotted cooling opening 144 is included in the upstream liner heat shield panel 85, the upstream liner heat shield panel 85 includes a heat shield panel connecting portion 150 arranged between respective ones of the plurality of slotted cooling openings 144. The heat shield panel connecting portion 150 may merely comprise a part of the upstream liner heat shield panel 85. The upstream liner heat shield panel 85 may also include a plurality of cooling passages 129 arranged at an upstream side 152 of the heat shield panel connecting portion 150, where the plurality of cooling passages 129 are spaced apart in the circumferential direction (C) along the upstream side 152 of the heat shield panel connecting portion 150. The cooling passages 129 may be similar to the cooling passages 128, and may provide a film cooling to the heat shield panel connecting portion 150.

Figure 6:
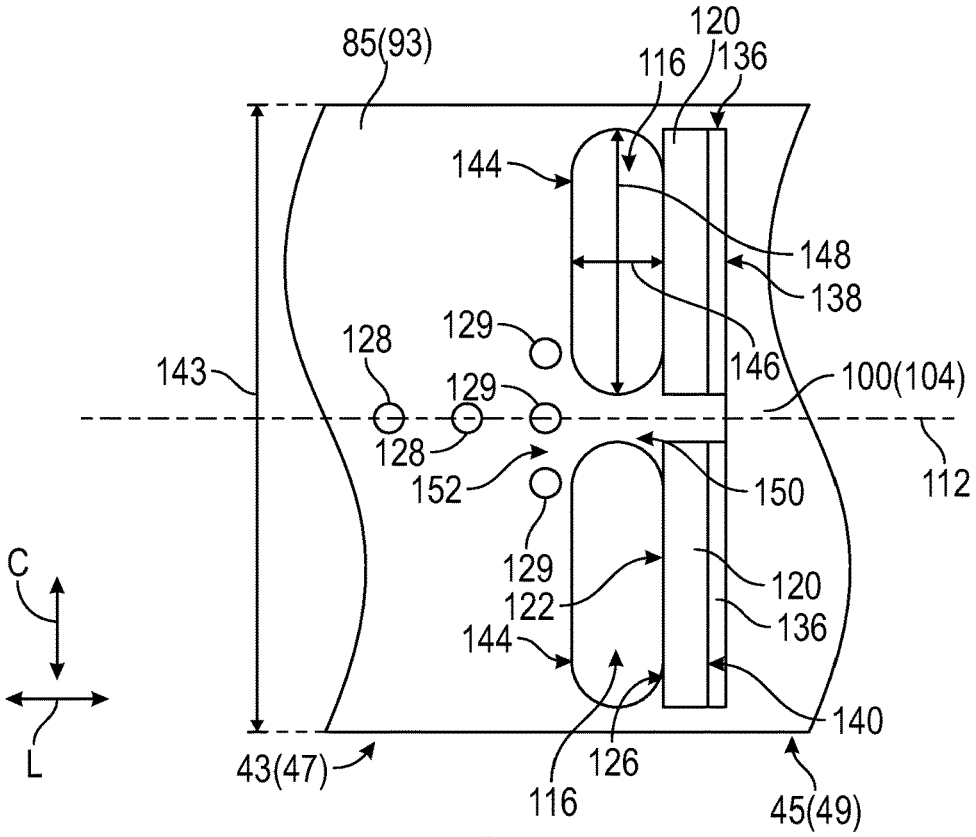
FIG. 6 is another alternate plan view of a part of the upstream liner portion and the downstream liner portion, according to another aspect of the present disclosure.

Referring still to FIG. 4, the fence 120 is shown as extending in the circumferential direction (C) across the heat shield panel width 143 at the downstream side 122 of each of the slotted cooling openings 144 so as to define a single fence 120. Referring to FIG. 6, which is an alternate arrangement of the plan view shown in FIG. 4, a plurality of fences 120 may be included instead. For example, when two slotted cooling openings 144 are provided in the upstream liner heat shield panel 85, two fences 120 may be included, where respective ones of the fences 120 are arranged at a respective downstream side 122 of the respective ones of the slotted cooling openings 144. In addition, a respective leakage cooling passage 136 may be arranged at the downstream side 140 of each respective fence 120.

Figure 7:
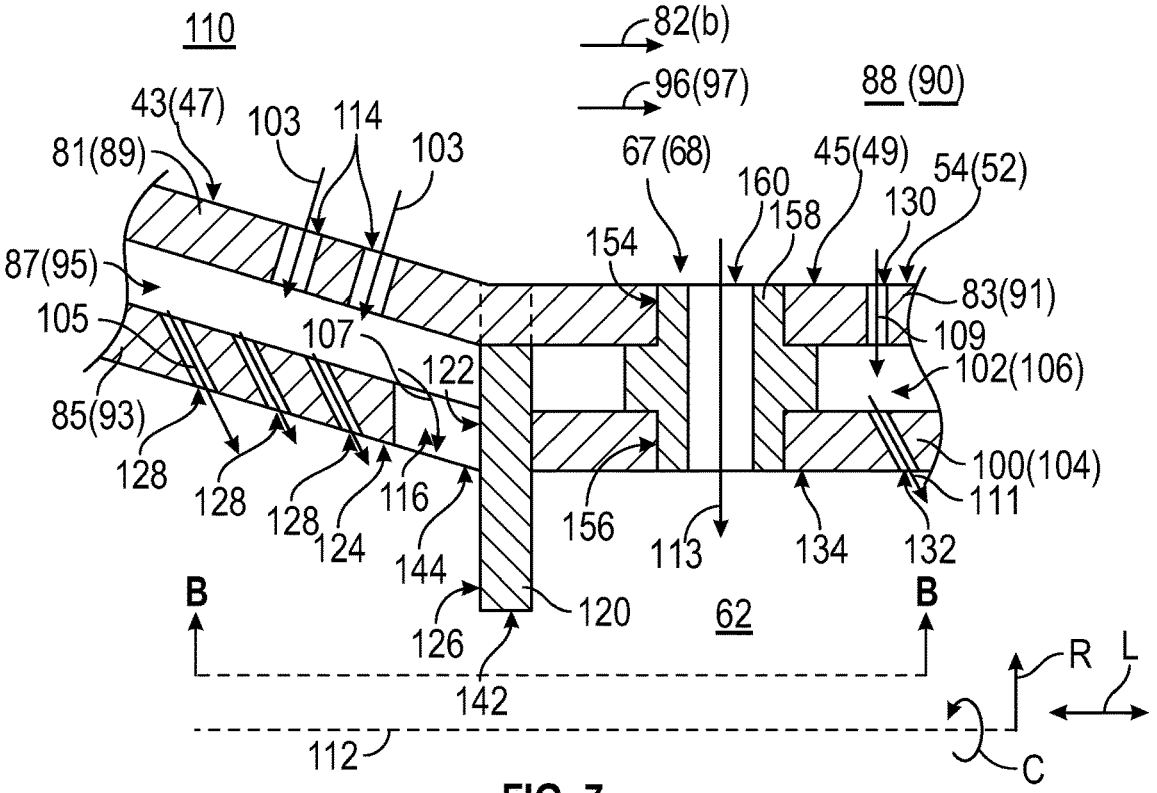
FIG. 7 is an alternate cross-sectional enlarged view similar to the aspect shown in FIG. 3 of a portion an upstream liner portion and a downstream liner portion, according to another aspect of the present disclosure.

FIG. 7 is an alternate cross-sectional enlarged view similar to the aspect shown in FIG. 3 of a portion an upstream liner portion and downstream liner portion, according to another aspect of the present disclosure. In the FIG. 7 aspect, the upstream liner portion 43 may be generally the same as the upstream liner portion 43 shown in any of the FIGS. 3 to 6 aspects. Thus, the upstream liner portion 43 of FIG. 7 may include the slotted cooling openings 144 and the fence 120 as shown in any of FIGS. 3 to 6. In FIG. 7, however, the downstream liner portion 45 may include an alternate arrangement. Similar to the FIGS. 3 to 6 aspects, the downstream liner portion 45 may include the cooling passages 130 through the downstream liner outer shell 83 to provide the airflow 109 to the downstream liner baffle cavity 102, and the cooling passages 132 through the downstream liner heat shield panel 100 to provide the airflow 111 for film cooling of the hot side surface 134 of the downstream liner heat shield panel 100. However, in the FIG. 7 aspect, the downstream liner outer shell 83 includes at least one downstream liner outer shell dilution opening 154 therethrough, and the downstream liner heat shield panel 100 includes a downstream liner heat shield panel dilution opening 156 therethrough. In addition, the downstream liner portion 45 includes a dilution jet grommet 158 extending through the downstream liner outer shell dilution opening 154 and the downstream liner heat shield panel dilution opening 156. The dilution jet grommet 158 includes a grommet dilution opening 160 extending therethrough to provide the dilution jet flow 113 of the dilution air therethrough from the outer flow passage 88 surrounding the downstream liner outer shell 83 into the combustion chamber 62. The dilution jet grommet 158 and the grommet dilution opening 160 may correspond to the outer liner dilution opening 67. Thus, in the FIG. 7 aspect, as was described above with regard to FIG. 3, a portion of the compressed air 82(*b*) that may otherwise be utilized for the dilution air may be provided through the heat shield panel cooling opening 116 to provide cooling at the gap 94 between the upstream liner heat shield panel 85 and the downstream liner heat shield panel 100, while the dilution jet grommet 158 with the grommet dilution opening 160 may provide the dilution jet flow 113 of the dilution air to effect dilution of the combustion gases 86 within the dilution zone 75 of the combustion chamber 62.

Figure 8:
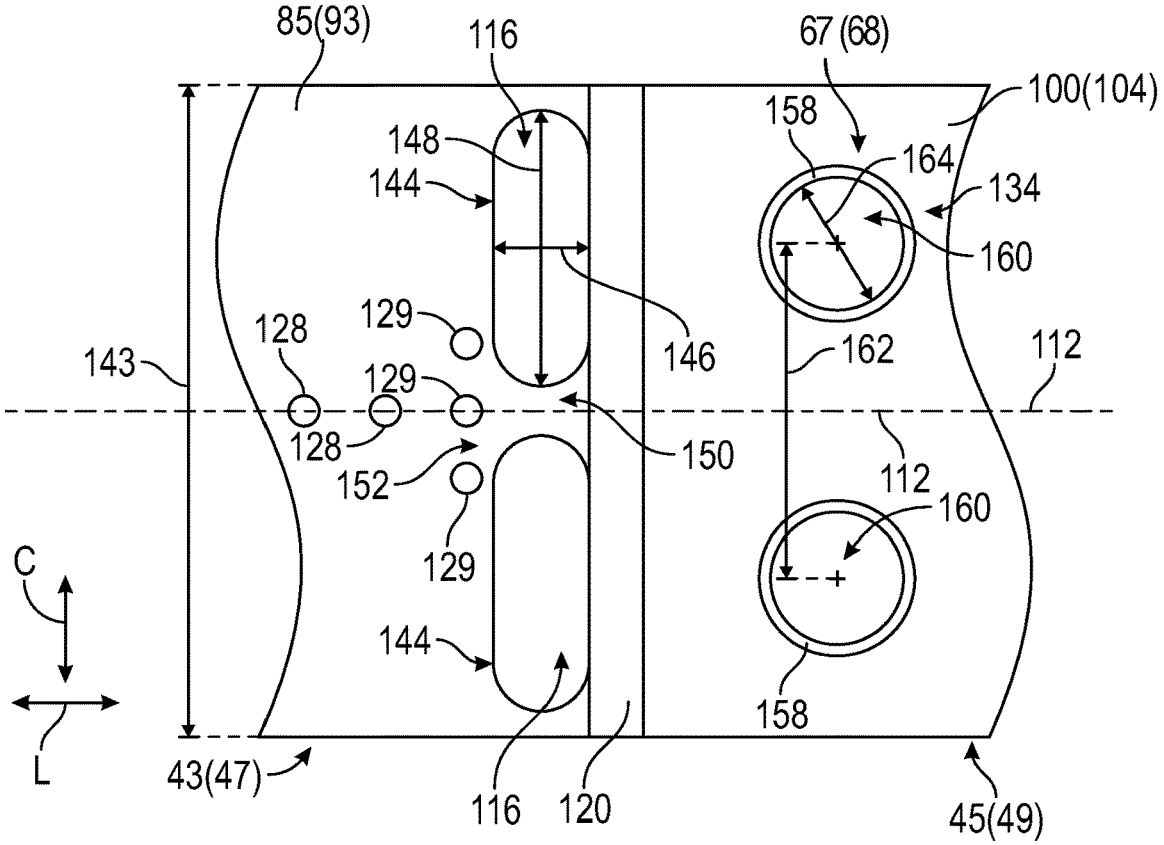
FIG. 8 is a plan view a part of the upstream liner portion and the downstream liner portion taken at view B-B of FIG. 7, according to an aspect of the present disclosure.

FIG. 8 is a plan view of a part of the upstream liner portion and the downstream liner portion taken at view B-B of FIG. 7, according to an aspect of the present disclosure. As shown in FIG. 8, the upstream liner portion 43 may have an arrangement with two slotted cooling openings 144 and a single fence 120, similar to that shown in FIG. 4. However, the upstream liner portion 43 may include the single slotted cooling opening 144 and the single fence 120 of the FIG. 5 aspect, or may include the two slotted cooling openings 144 and the two fences 120 of FIG. 6. Further, while not shown in FIG. 7 or 8, the leakage cooling passage 136 as shown in FIGS. 3 to 6 may also be included in the FIG. 8 aspect. In FIG. 8, two dilution jet grommets 158 are shown as being included in the downstream liner portion 45. The dilution jet grommets 158 may be spaced apart from one another a distance 162 in the circumferential direction (C). The grommet dilution opening 160 may have a dilution jet size 164 (e.g., a diameter), and the dilution jet size 164 may be based on a desired amount of the dilution jet flow 113 of the dilution air to be provided through the grommet dilution opening 160. Of course, the grommet dilution opening 160 is not limited to being a cylindrical opening and may be other shapes instead, and the number of dilution jet grommets 158 is not limited to two as shown in FIG. 8, and more than two dilution jet grommets 158 may be implemented instead. In addition, one dilution jet grommet 158 may be included instead, such as in conjunction with the single slotted cooling opening 144 aspect shown in FIG. 5.

Figure 9:
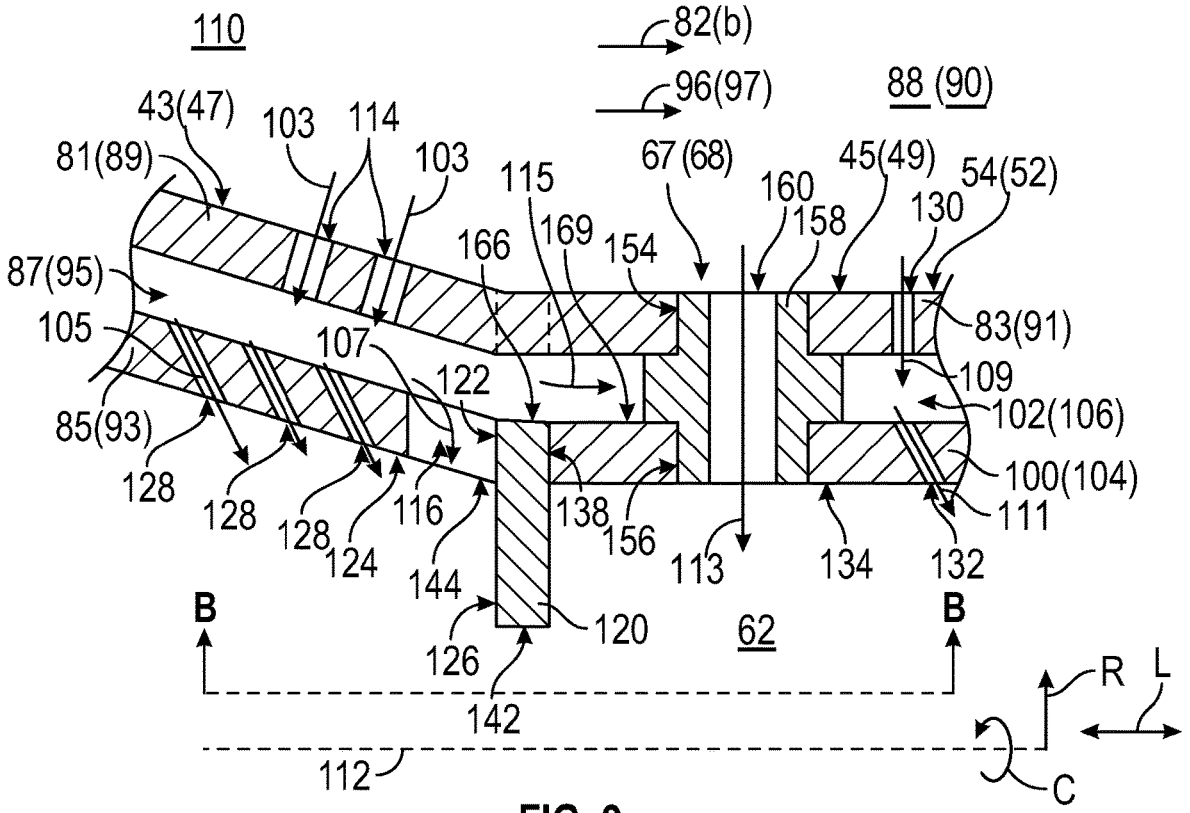
FIG. 9 is an alternate cross-sectional enlarged view similar to the aspect shown in FIG. 7 of a portion an upstream liner portion and a downstream liner portion, according to another aspect of the present disclosure.

FIG. 9 is an alternate cross-sectional enlarged view similar to the FIG. 7 aspect of a portion an upstream liner portion and a downstream liner portion, according to another aspect of the present disclosure. The FIG. 9 aspect may be similar to the FIG. 7 aspect, but instead of the fence 120 being connected to the downstream liner outer shell 83 as shown in FIG. 7, the fence 120 is shown as being connected to the upstream end 138 of the downstream liner heat shield panel 100. The fence 120 may be connected with the downstream liner heat shield panel 100 by, for example, being brazed, or may be formed integral with (i.e., as one piece) the downstream liner heat shield panel 100. In addition, as shown in FIG. 9, the fence 120 may not extend across the downstream liner baffle cavity 102, but instead, may be arranged such that an outer end 166 of the fence 120 is continuous with a cold side surface 169 of the downstream liner heat shield panel 100. With such an arrangement, an airflow 115 of a portion of the compressed air in the upstream liner baffle cavity 87 can flow into the downstream liner baffle cavity 102 to at least partially form the airflow 111 through the cooling passages 132 in the downstream liner heat shield panel 100.

Figure 10:
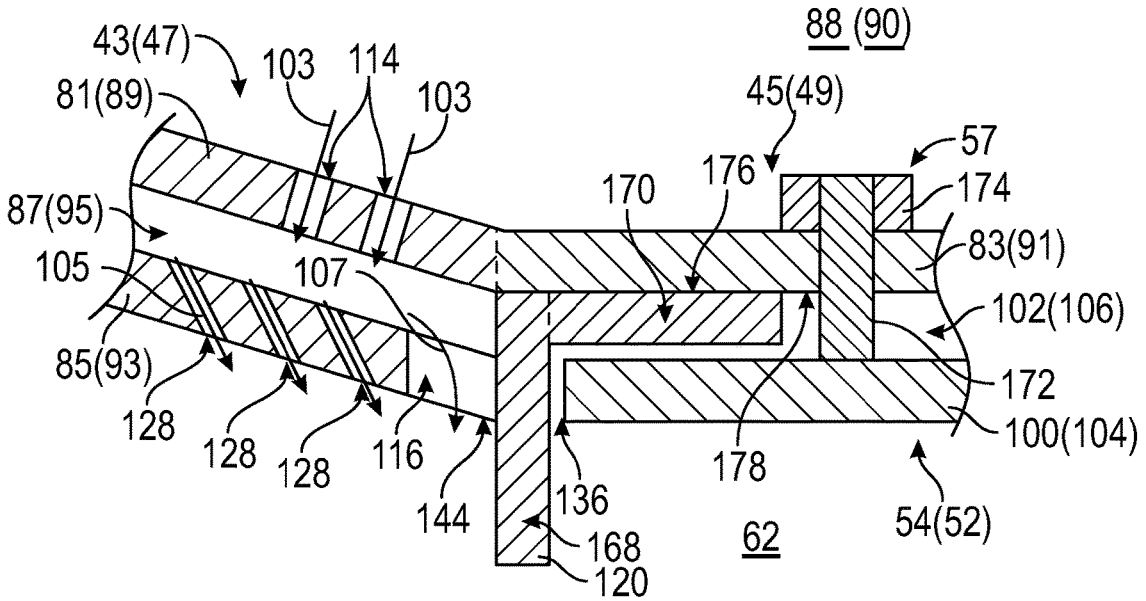
FIG. 10 is a cross-sectional view of a part of the upstream liner portion and the downstream liner portion, according to an aspect of the present disclosure.

Various aspects for connecting the fence 120 to the outer liner 54 will now be described with regard to FIGS. 10 to 14. FIG. 10 is a cross-sectional view of a part of the upstream liner portion 43 and the downstream liner portion 45, according to an aspect of the present disclosure. In FIGS. 10 to 13, the upstream liner portion 43 may correspond to the upstream liner portion 43 shown in any of the aspects of FIGS. 3 to 9, and the downstream liner portion 45 may correspond to the downstream liner portion 45 shown in the FIG. 3 aspect. In the FIG. 10 aspect, the fence 120 is seen to include a fence portion 168 and a base portion 170, which may be formed integral as a single fence 120. In connecting the fence 120, an outer surface 176 of the base portion 170 may be brazed with an inner surface 178 of the downstream liner outer shell 83. The downstream liner heat shield panel 100 and the downstream liner outer shell 83 are connected together via the shell-to-panel connecting member 57, which may include a stud 172 extending from the downstream liner heat shield panel 100 and a retention member 174, such as a nut, connected to the stud 172.

Figure 11:
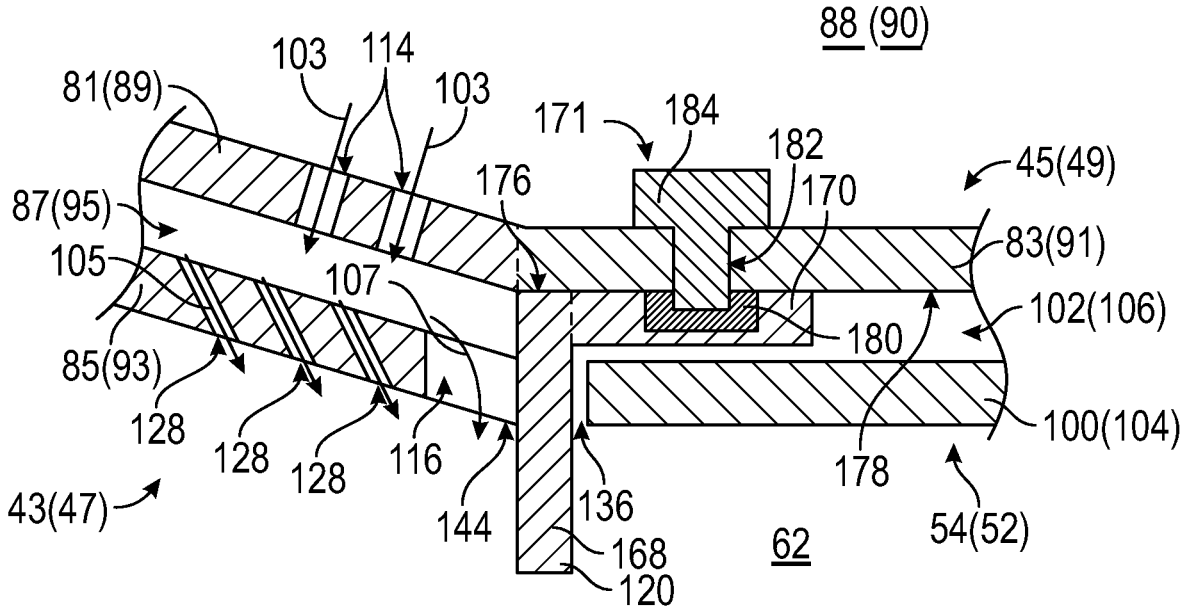
FIG. 11 is a cross-sectional view of a part of the upstream liner portion and the downstream liner portion, according to another aspect of the present disclosure.

FIG. 11 is a cross-sectional view of a part of the upstream liner portion and the downstream liner portion, according to another aspect of the present disclosure. In the FIG. 11 aspect, the fence 120 is also seen to include the fence portion 168 and the base portion 170. The base portion 170 of FIG. 11, however, includes an insert 180 for connecting the fence 120 to the downstream liner outer shell 83. The downstream liner outer shell 83 includes a fastener opening 182 therethrough, and a fastener 184, such as a bolt, may threadedly engage with the insert 180 so as to secure the outer surface 176 of the base portion 170 against the inner surface 178 of the downstream liner outer shell 83.

Figure 12:
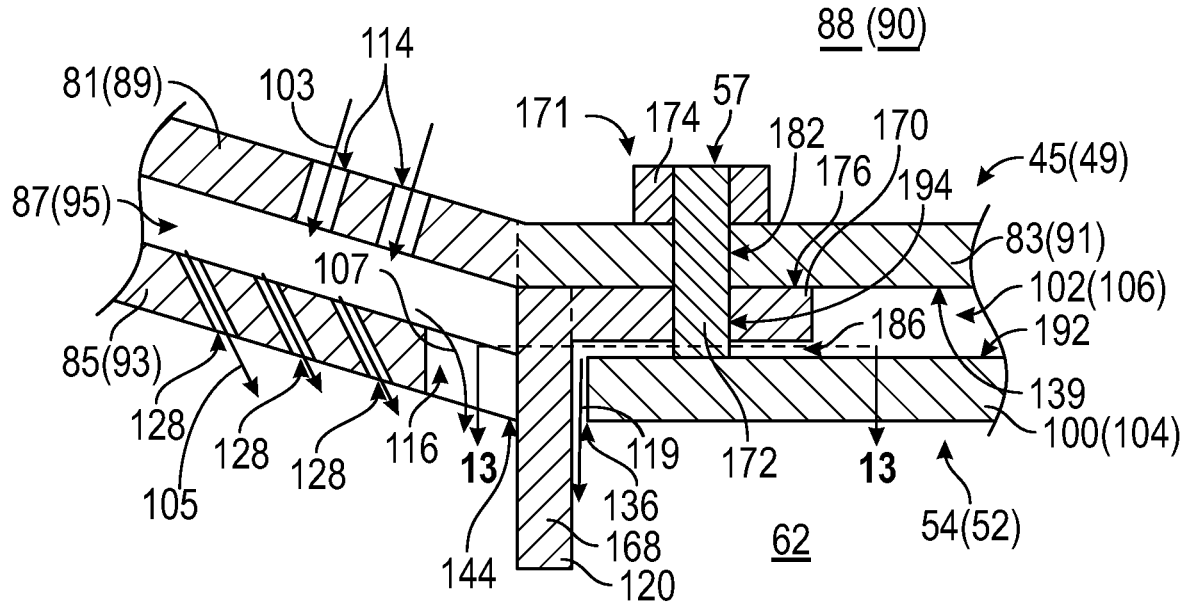
FIG. 12 is a cross-sectional view of a part of the upstream liner portion and the downstream liner portion, according to another aspect of the present disclosure.
Figure 13:
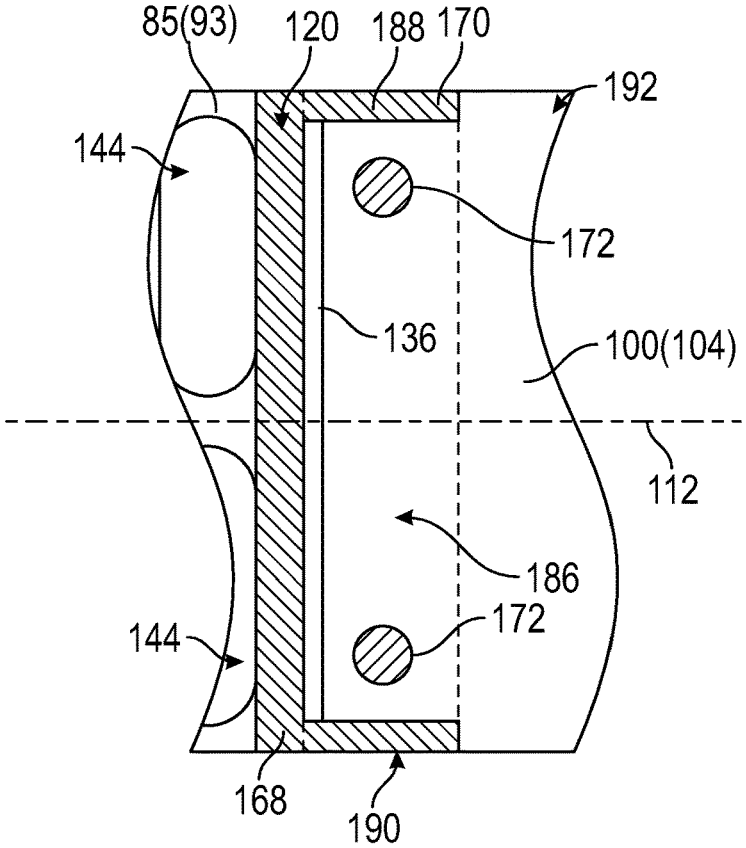
FIG. 13 is a cross-sectional view taken at plane 13-13 of FIG. 12, according to an aspect of the present disclosure.

FIG. 12 is a cross-sectional view of a part of the upstream liner portion and the downstream liner portion, according to another aspect of the present disclosure. FIG. 13 is a cross-sectional view taken at plane 13-13 of FIG. 12. Referring collectively to FIGS. 12 and 13, the fence 120 is also seen to include the fence portion 168 and the base portion 170. The base portion 170, however, includes a leakage cooling flow passage 186 to allow a leakage flow 119 of the compressed air to flow through the leakage cooling passage 136. As shown in FIG. 13, the base portion 170 includes a first outer end 188 and a second outer end 190 that engage with a cold side surface 192 of the downstream liner heat shield panel 100. In FIG. 12, the fence 120 may be connected to the downstream liner portion 45 via a bolted connection 171. For example, the downstream liner heat shield panel 100 includes the stud 172 extending therefrom, and the base portion 170 includes a fastener opening 194 therethrough. The stud 172 is engaged through the fastener opening 194 such that the base portion 170 is clamped between an inner surface 139 of the downstream liner outer shell 83 and the cold side surface 192 of the downstream liner heat shield panel 100. The retention member 174 threadedly engages the stud 172 so as to complete the bolted connection 171 of the fence 120.

Figure 14:
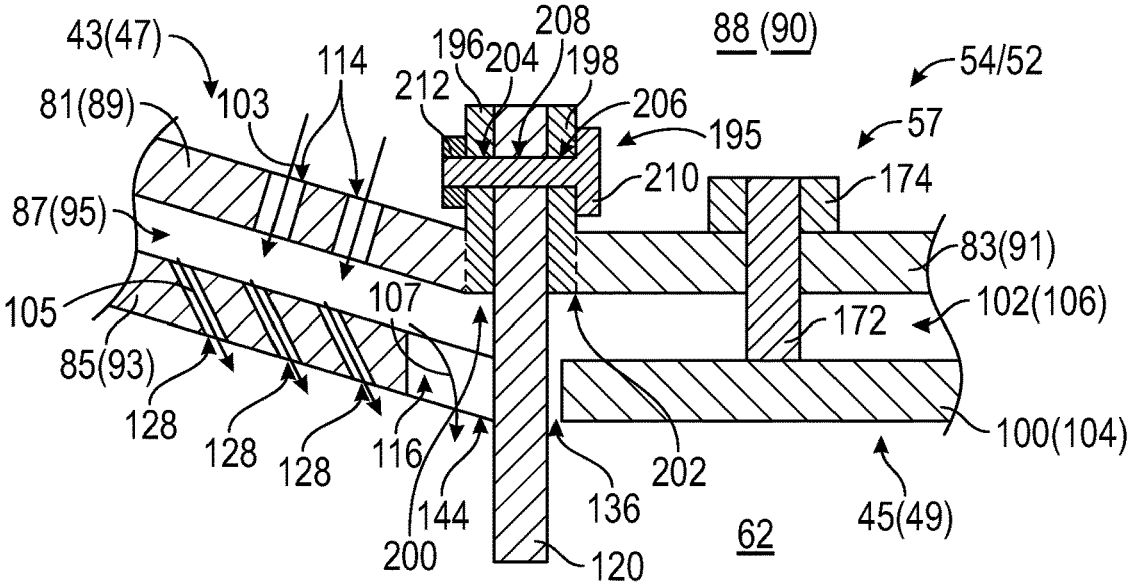
FIG. 14 is a cross-sectional view of a part of the upstream liner portion and the downstream liner portion, according to still another aspect of the present disclosure.

FIG. 14 is a cross-sectional view of a part of the upstream liner outer and the downstream liner portion, according to still another aspect of the present disclosure. In FIG. 14, the upstream liner outer shell 81 and the downstream liner outer shell 83 are shown as constituting separate outer shell portions, as compared to the aspects shown in FIGS. 10 to 13, where the upstream liner outer shell 81 and the downstream liner outer shell 83 may be integral so as to form a single outer shell (e.g., by being brazed together, or being manufactured as a single outer shell unit). Thus, in FIG. 14, in connecting the upstream liner outer shell 81 and the downstream liner outer shell 83, as well as the fence 120, a bolted connection 195 is implemented in which the upstream liner outer shell 81 includes a connecting flange 196 at a downstream end 200 of the upstream liner outer shell 81, and the downstream liner outer shell 83 includes a connecting flange 198 at an upstream end 202 of the downstream liner outer shell 83. The connecting flange 196 of the upstream liner outer shell 81 includes a fastener opening 204 therethrough, and the connecting flange 198 of the downstream liner outer shell 83 includes a fastener opening 206 therethrough. The fence 120 includes a fastener opening 208 therethrough. In connecting the upstream liner outer shell 81, the fence 120, and the downstream liner outer shell 83 to form the bolted connection 195, a fastener 210, such as a bolt, is inserted through the fastener opening 206 of the connecting flange 198, through the fastener opening 208 of the fence 120, and through the fastener opening 204 of the connecting flange 196, and a retention member 212, such as a nut, threadedly engages with the fastener 210 so as to connect the fence 120 between the upstream liner outer shell 81 and the downstream liner outer shell 83.

Figure 15:
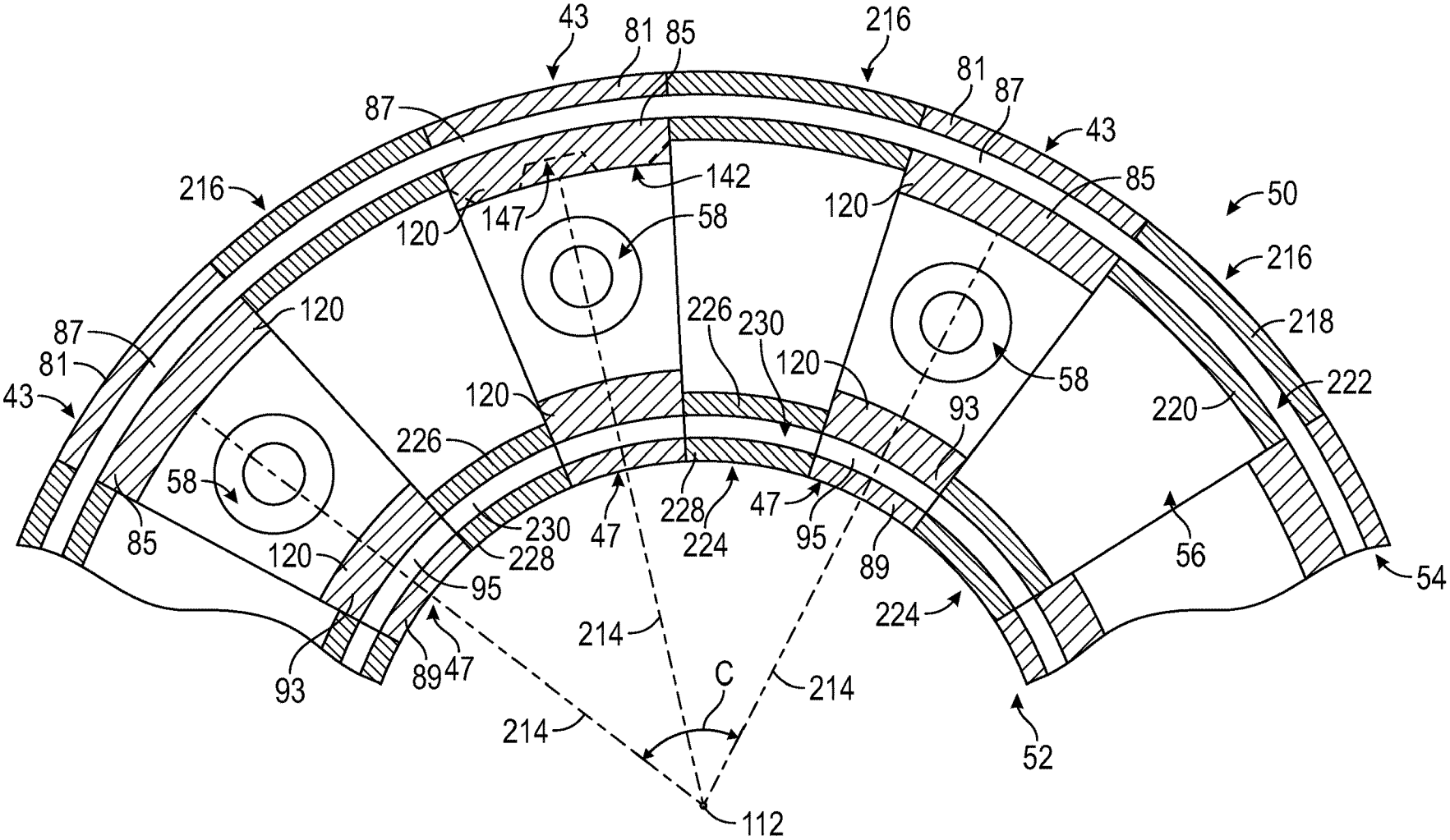
FIG. 15 is a cross-sectional view of a portion of the combustor liner, taken at plane 15-15 of FIG. 2, according to an aspect of the present disclosure.

FIG. 15 is a cross-sectional view of a portion of the combustor liner 50, taken at plane 15-15 of FIG. 2, according to an aspect of the present disclosure. In FIG. 15, the outer liner 54 is seen to extend circumferentially about the combustor centerline axis 112, and the inner liner 52 is seen to extend circumferentially about the combustor centerline axis 112. In addition, the dome assembly 56 extends circumferentially about the combustor centerline axis 112 and includes a plurality of the mixer assemblies 58 circumferentially spaced apart about the dome assembly 56. As shown in FIG. 15, respective ones of the upstream liner portion 43 of the outer liner 54, and respective ones of the upstream liner portion 47 of the inner liner 52 may be radially aligned with respective ones of the mixer assemblies 58 with respect to a radial line 214 extending radially outward from the combustor centerline axis 112. The outer liner 54 further includes a plurality of intermediate upstream liner portions 216 circumferentially arranged between respective ones of the upstream liner portions 43. Each of the intermediate upstream liner portions 216 may include an intermediate upstream liner outer shell 218, an intermediate upstream liner heat shield panel 220, and an intermediate baffle cavity 222 defined between the intermediate upstream liner outer shell 218 and the intermediate upstream liner heat shield panel 220. The intermediate upstream liner portions 216 may not include the heat shield panel cooling opening 116 or the slotted cooling opening 144, and may also not include the fence 120. The intermediate upstream liner outer shell 218 may, however, include cooling passages similar to the upstream liner outer shell cooling openings 114 (FIG. 3), and the intermediate upstream liner heat shield panel 220 may include cooling passages similar to the cooling passage 128 (FIG. 3).

Similarly, the inner liner 52 further includes a plurality of intermediate upstream liner portions 224 circumferentially arranged between respective ones of the upstream liner portions 47. Each of the intermediate upstream liner portions 224 may include an intermediate upstream liner outer shell 228, an intermediate upstream liner heat shield panel 226, and an intermediate baffle cavity 230 defined between the intermediate upstream liner outer shell 228 and the intermediate upstream liner heat shield panel 226. The intermediate upstream liner portions 224 may not include the heat shield panel cooling opening 116 or the slotted cooling opening 144, and may also not include the fence 120. The intermediate upstream liner outer shell 228 may, however, include cooling passages similar to the upstream liner outer shell cooling openings 114 (FIG. 3), and the intermediate upstream liner heat shield panel 226 may include cooling passages similar to the cooling passage 128 (FIG. 3). Thus, by providing the upstream liner portion 43 of the outer liner 54 and the upstream liner portion 47 of the inner liner 52 aligned with respective ones of the mixer assemblies 58, hot spots on the upstream liner heat shield panel 85 and on the upstream liner heat shield panel 93 can be efficiently cooled utilizing at least a portion of the compressed air 82(*b*) that may otherwise be utilized as dilution air through the at least one heat shield panel cooling opening 116 and utilizing the fence 120.

In addition, in FIG. 15, the inner end 142 of the fence 120 is shown as extending in the circumferential direction (C) at a constant radius with respect to the combustor centerline axis 112. However, the inner end 142 of the fence 120 need not be continuous circumferentially, and instead, a staggered inner end 147 may be provided for circumferentially. The staggered inner end 147 may define generally trapezoidal-shaped segments, or may define a smooth curved waveform, or may define other shapes instead.

Figure 16:
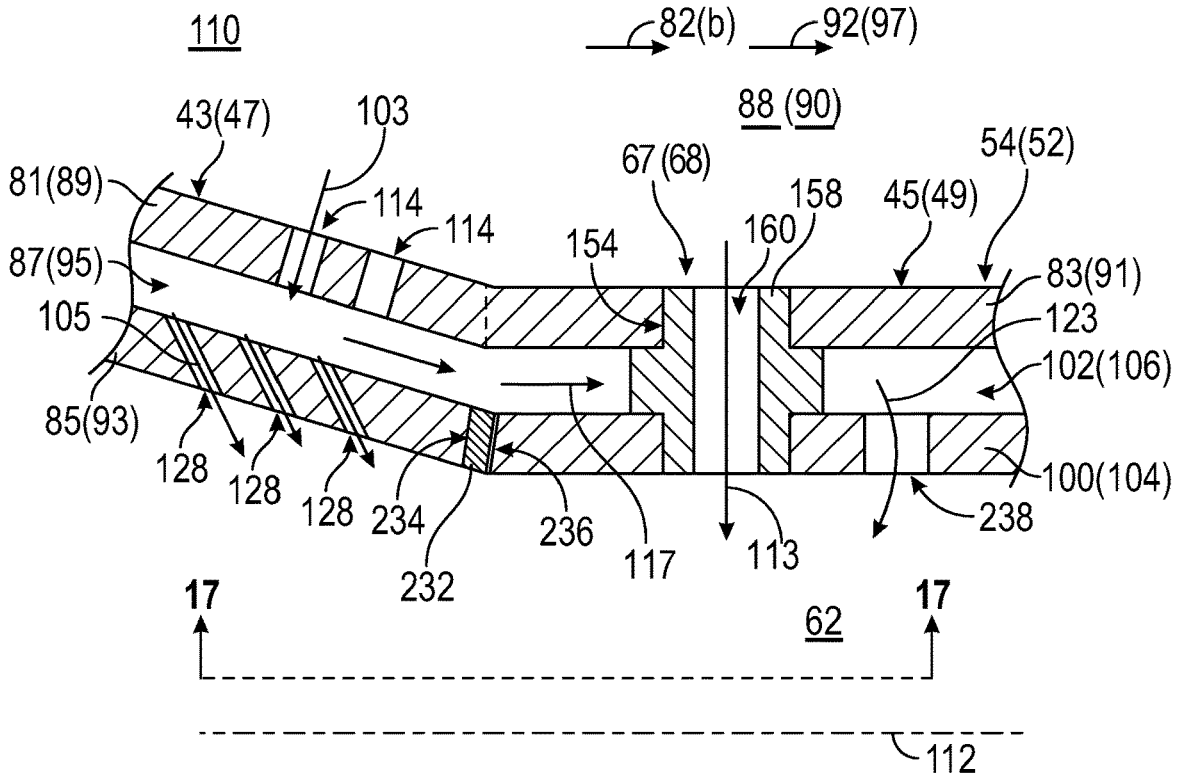
FIG. 16 is an alternate cross-sectional enlarged view similar to the aspect shown in FIG. 7 of a portion an upstream liner portion and a downstream liner portion, according to another aspect of the present disclosure.
Figure 17:
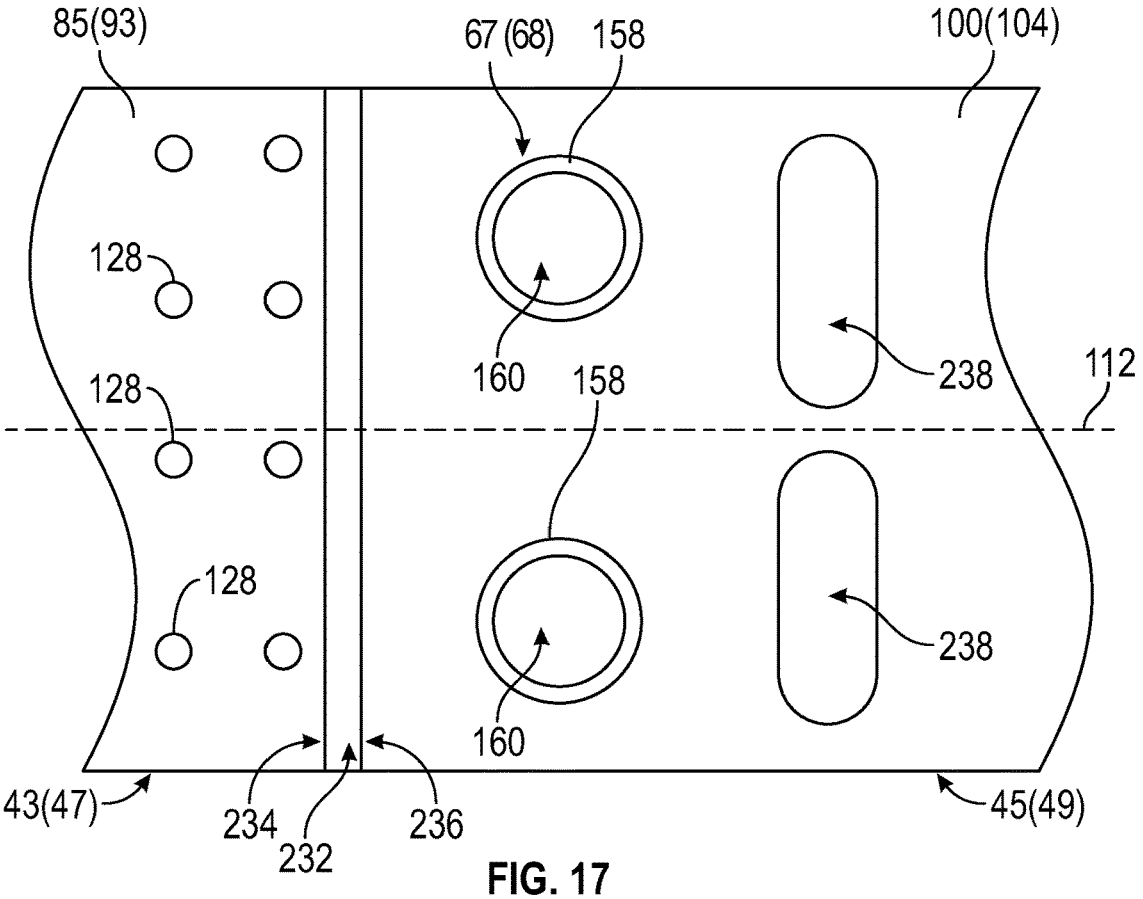
FIG. 17 is a plan view a part of the upstream liner portion and the downstream liner portion taken at view 17-17 of FIG. 16, according to an aspect of the present disclosure.

FIG. 16 is an alternate cross-sectional enlarged view similar to the aspect shown in FIG. 7 of a portion an upstream liner portion and a downstream liner portion, according to another aspect of the present disclosure. FIG. 17 is a plan view a part of the upstream liner portion and the downstream liner portion taken at view 17-17 of FIG. 16, according to an aspect of the present disclosure. Referring collectively to FIGS. 16 and 17, the fence 120 and the slotted cooling openings 144 are omitted and instead, a sealed joint 232 is provided between a downstream end 234 of the upstream liner heat shield panel 85 and an upstream end 236 of the downstream liner heat shield panel 100. Thus, an airflow 117 of the compressed air within the upstream liner baffle cavity 87 flows into the downstream liner baffle cavity 102. The downstream liner portion 45 is seen to include the dilution jet grommet 158 that provides the dilution jet flow 113 of dilution air therethrough into the combustion chamber 62. In the aspect of FIGS. 16 and 17, at least one slotted cooling opening 238 is included through the downstream liner heat shield panel 100 to provide an airflow 123 of the compressed air therethrough from the downstream liner baffle cavity 102 into the combustion chamber 62. The slotted cooling openings 238 may be similar to the slotted cooling openings 144. Thus, the arrangement of FIGS. 16 and 17 provides for cooling of the downstream heat shield panel 100.

With each of the foregoing aspects, at least a portion of the compressed air within the outer flow passage and within the inner flow passage that may otherwise be utilized for dilution of the combustion gases may instead be utilized for cooling of the upstream liner heat shield panel. By implementing the dilution fence at the cooling opening through the upstream liner heat shield panel, the airflow provided therethrough can also provide at least a partial dilution of the combustion gases, while at the same time, providing cooling to hot spots of the liner near the cooling opening.

While the foregoing description relates generally to a gas turbine engine, the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A combustor for a gas turbine includes a combustor liner including (a) an upstream liner portion, and (b) a downstream liner portion, the upstream liner portion comprising (i) an upstream liner outer shell, and (ii) at least one upstream liner heat shield panel connected to the upstream liner outer shell, an upstream liner baffle cavity defined between the upstream liner outer shell and the at least one upstream liner heat shield panel, the upstream liner outer shell including at least one upstream liner outer shell cooling opening therethrough for providing an airflow of compressed air to the upstream liner baffle cavity, and the at least one upstream liner heat shield panel including at least one heat shield panel cooling opening therethrough at a downstream end of the upstream liner heat shield panel, and (c) at least one fence arranged at a downstream side of the at least one heat shield panel cooling opening and extending beyond a hot side surface of the at least one upstream liner heat shield panel into a combustion chamber, wherein the at least one heat shield panel cooling opening is arranged to provide a flow of the compressed air therethrough from the upstream liner baffle cavity for cooling of the at least one upstream liner heat shield panel and for providing at least partial dilution of combustion gases within the combustion chamber.

The combustor according to the preceding clause, wherein the combustor liner comprises at least one of an outer liner extending circumferentially about a combustor centerline axis, and an inner liner extending circumferentially about the combustor centerline axis.

The combustor according to any preceding clause, wherein the at least one fence is connected to the upstream liner outer shell.

The combustor according to any preceding clause, wherein the at least one heat shield panel cooling opening is a slotted cooling opening extending in a circumferential direction with respect to a combustor centerline axis.

The combustor according to any preceding clause, wherein the at least one heat shield panel cooling opening comprises a plurality of slotted cooling openings arranged adjacent to one another in the circumferential direction.

The combustor according to any preceding clause, wherein the at least one fence comprises a single fence extending in the circumferential direction at the downstream side of the plurality of slotted cooling openings.

The combustor according to any preceding clause, wherein a heat shield panel connecting portion is arranged between respective ones of the plurality of slotted cooling openings, and each heat shield panel further includes a plurality of cooling passages therethrough arranged at an upstream side of the heat shield panel connecting portion, the plurality of cooling passages providing a film cooling to the heat shield panel connecting portion.

The combustor according to any preceding clause, wherein the at least one fence comprises a plurality of fences, respective ones of the plurality of fences being arranged at a respective downstream side of respective ones of the plurality of slotted cooling openings.

The combustor according to any preceding clause, wherein each of the plurality of fences is connected to the upstream liner heat shield panel.

The combustor according to any preceding clause, wherein the downstream liner portion includes (i) a downstream liner outer shell, and (ii) at least one downstream liner heat shield panel connected to the downstream liner outer shell, a downstream liner baffle cavity being defined between the downstream liner outer shell and the at least one downstream liner heat shield panel, the downstream liner portion including a dilution opening extending through a downstream liner outer shell dilution opening of the downstream liner outer shell, and through a downstream liner heat shield panel dilution opening through the downstream liner heat shield panel.

The combustor according to any preceding clause, wherein the downstream liner portion includes at least one dilution jet grommet extending through the downstream liner outer shell dilution opening and the downstream liner heat shield panel dilution opening, the at least one dilution jet grommet providing a dilution jet flow of compressed air therethrough from a flow passage surrounding the downstream liner outer shell into the combustion chamber.

The combustor according to any preceding clause, wherein the at least one fence is connected to the downstream liner outer shell, and a leakage cooling passage is provided between the fence and an upstream end of the at least one downstream liner heat shield panel.

The combustor according to any preceding clause, wherein the at least one fence is connected to the downstream liner outer shell by a bolted connection.

The combustor according to any preceding clause, wherein the at least one fence is connected to the downstream liner outer shell via brazing.

The combustor according to any preceding clause, wherein the at least one fence is formed integral with the downstream liner outer shell.

The combustor according to any preceding clause, wherein the combustor liner comprises at least one of an outer liner extending circumferentially about a combustor centerline axis, and an inner liner extending circumferentially about the combustor centerline axis, the combustor further comprises a dome assembly extending circumferentially about the combustor centerline axis and arranged at an upstream end of the combustor liner, the dome assembly including a plurality of mixer assemblies circumferentially spaced apart about the dome assembly, the at least one upstream liner heat shield panel comprising a plurality of upstream liner heat shield panels, respective ones of the plurality of upstream liner heat shield panels being arranged with corresponding ones of the plurality of mixer assemblies.

The combustor according to any preceding clause, wherein the upstream liner portion further comprises a plurality of intermediate heat shield panels, respective ones of the plurality of intermediate heat shield panels being arranged circumferentially between respective ones of the plurality of upstream liner heat shield panels.

The combustor according to any preceding clause, wherein the fence includes a base portion and a fence portion, and the base portion is connected to the downstream liner outer shell.

The combustor according to any preceding clause, wherein the base portion is connected with the downstream liner outer shell via brazing.

The combustor according to any preceding clause, wherein a leakage airflow passage is provided between the base portion and the downstream liner heat shield panel, and between the upstream side of the downstream liner heat shield panel a downstream side of the fence portion.

The combustor according to any preceding clause, wherein the base portion includes an insert for connecting the fence to the downstream liner outer shell.

The combustor according to any preceding clause, wherein the downstream liner outer shell includes a fastener opening therethrough, and a fastener threadedly engages with the insert so as to secure the base portion against the downstream liner outer shell.

The combustor according to any preceding clause, wherein the fence is connected to the downstream liner portion via a bolted connection.

The combustor according to any preceding clause, wherein the downstream liner heat shield panel includes a stud extending therefrom, and the base portion includes a fastener opening therethrough, the stud being engaged through the fastener opening such that the base portion is clamped between the downstream liner outer shell and the downstream liner heat shield panel.

The combustor according to any preceding clause, wherein the upstream liner outer shell and the downstream liner outer shell are separate outer shell portions, the upstream liner outer shell, the downstream liner outer shell, and the fence being connected via a bolted connection.

The combustor according to any preceding clause, wherein the upstream liner outer shell includes a connecting flange at a downstream end of the upstream liner outer shell, and the downstream liner outer shell includes a connecting flange at an upstream end of the downstream liner outer shell.

The combustor according to any preceding clause, wherein connecting flange of the upstream liner outer shell includes a fastener opening therethrough, the connecting flange of the downstream liner outer shell includes a fastener opening therethrough, and the fence includes a fastener opening therethrough.

The combustor according to any preceding clause, wherein the upstream liner outer shell, the fence, and the downstream liner outer shell are connected via a fastener to form the bolted connection.

A gas turbine including a combustor, the combustor including an outer liner extending circumferentially about a combustor centerline axis, an inner liner extending circumferentially about the combustor centerline axis, a combustion chamber being defined between the outer liner and the inner liner, a dome assembly extending between the outer liner and the inner liner, and a plurality of mixer assemblies arranged in the dome assembly, wherein, at least one of the outer liner and the inner liner includes (a) an upstream liner portion, and (b) a downstream liner portion, the upstream liner portion comprising (i) an upstream liner outer shell extending circumferentially about the combustor centerline axis, and (ii) at least one upstream liner heat shield panel connected to the upstream liner outer shell, an upstream liner baffle cavity defined between the upstream liner outer shell and the upstream liner heat shield panel, the upstream liner outer shell including at least one upstream liner outer shell cooling opening therethrough for providing a flow of compressed air to the upstream liner baffle cavity, and the upstream liner heat shield panel including at least one heat shield cooling opening therethrough at a downstream end of the upstream liner heat shield panel, and (c) at least one fence arranged at a downstream side of the at least one heat shield panel cooling opening and extending beyond a hot side surface of the upstream liner heat shield panel into the combustion chamber, wherein the at least one heat shield panel cooling opening is arranged to provide a flow of the compressed air therethrough from the upstream liner baffle cavity for cooling of the at least one upstream liner heat shield panel and for providing at least partial dilution of combustion gases within the combustion chamber.

The gas turbine according to the preceding clause, wherein the at least one upstream liner heat shield panel comprises a plurality of upstream liner heat shield panels, and respective ones of the plurality of upstream liner heat shield panels are arranged circumferentially to correspond with respective ones of the plurality of mixer assemblies.

The gas turbine according to any preceding clause, wherein the at least one heat shield cooling opening comprises a slotted cooling opening.

Although the foregoing description is directed to some exemplary embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A combustor for a gas turbine, the combustor comprising:

a combustor liner including:

(a) a downstream liner portion comprising a downstream liner outer shell;

(b) an upstream liner portion comprising:

(i) an upstream liner outer shell; and (ii) at least one upstream liner heat shield panel connected to the upstream liner outer shell, an upstream liner baffle cavity defined between the upstream liner outer shell and the at least one upstream liner heat shield panel, the upstream liner outer shell including at least one upstream liner outer shell cooling opening therethrough for providing an airflow of compressed air to the upstream liner baffle cavity, and the at least one upstream liner heat shield panel including at least one slot heat shield panel cooling opening extending in a circumferential direction with respect to a combustor centerline axis, and the at least one slot heat shield panel cooling opening extending through the at least one upstream liner heat shield panel at a downstream end of the at least one upstream liner heat shield panel; and (c) at least one planar fence extending in the circumferential direction across a downstream side of the at least one slot heat shield panel cooling opening and extending beyond a hot side surface of the at least one upstream liner heat shield panel into a combustion chamber, wherein the at least one slot heat shield panel cooling opening is arranged through the at least one upstream liner heat shield panel to provide an airflow of the compressed air therethrough in a substantially radial direction with respect to the combustor centerline axis from the upstream liner baffle cavity for cooling of the at least one upstream liner heat shield panel and for providing at least partial dilution of combustion gases within the combustion chamber, and wherein the at least one planar fence is connected to one of the upstream liner outer shell or the downstream liner outer shell.

2. The combustor according to claim 1, wherein the combustor liner comprises at least one of an outer liner extending circumferentially about a combustor centerline axis, and an inner liner extending circumferentially about the combustor centerline axis.

3. The combustor according to claim 1, wherein the at least one slot heat shield panel cooling opening comprises a plurality of slot heat shield panel cooling openings arranged adjacent to one another in the circumferential direction.

4. The combustor according to claim 3, wherein the at least one planar fence comprises a single planar fence extending in the circumferential direction at the downstream side of the plurality of slot heat shield panel cooling openings.

5. The combustor according to claim 3, wherein a heat shield panel connecting portion is arranged between respective ones of the plurality of slot heat shield panel cooling openings, and each heat shield panel further includes a plurality of cooling passages therethrough arranged at an upstream side of the heat shield panel connecting portion, the plurality of cooling passages providing a film cooling to the heat shield panel connecting portion.

6. The combustor according to claim 3, wherein the at least one planar fence comprises a plurality of planar fences, respective ones of the plurality of planar fences being arranged at a respective downstream side of respective ones of the plurality of slot heat shield panel cooling openings.

7. The combustor according to claim 6, wherein each of the plurality of planar fences is connected to the at least one upstream liner heat shield panel.

8. The combustor according to claim 1, wherein the downstream liner portion includes at least one downstream liner heat shield panel connected to the downstream liner outer shell, a downstream liner baffle cavity being defined between the downstream liner outer shell and the at least one downstream liner heat shield panel, the downstream liner portion including a dilution opening extending through a downstream liner outer shell dilution opening of the downstream liner outer shell, and through a downstream liner heat shield panel dilution opening through the at least one downstream liner heat shield panel.

9. The combustor according to claim 8, wherein the downstream liner portion includes at least one dilution jet grommet extending through the downstream liner outer shell dilution opening and the downstream liner heat shield panel dilution opening, the at least one dilution jet grommet providing a dilution jet flow of compressed air therethrough from a flow passage surrounding the downstream liner outer shell into the combustion chamber.

10. The combustor according to claim 8, wherein the at least one planar fence is connected to the downstream liner outer shell, and a leakage cooling passage is provided between the at least one planar fence and an upstream end of the at least one downstream liner heat shield panel.

11. The combustor according to claim 10, wherein the at least one planar fence is connected to the downstream liner outer shell by a bolted connection.

12. The combustor according to claim 10, wherein the at least one planar fence is connected to the downstream liner outer shell via brazing.

13. The combustor according to claim 10, wherein the at least one planar fence is formed integral with the downstream liner outer shell.

14. The combustor according to claim 8, wherein the combustor liner comprises at least one of an outer liner extending circumferentially about a combustor centerline axis, and an inner liner extending circumferentially about the combustor centerline axis, the combustor further comprises a dome assembly extending circumferentially about the combustor centerline axis and arranged at an upstream end of the combustor liner, the dome assembly including a plurality of mixer assemblies circumferentially spaced apart about the dome assembly, the at least one upstream liner heat shield panel comprising a plurality of upstream liner heat shield panels, respective ones of the plurality of upstream liner heat shield panels being arranged with corresponding ones of the plurality of mixer assemblies.

15. The combustor according to claim 14, wherein the upstream liner portion further comprises a plurality of intermediate heat shield panels, respective ones of the plurality of intermediate heat shield panels being arranged circumferentially between respective ones of the plurality of upstream liner heat shield panels.

16. A gas turbine comprising:

a combustor comprising:

an outer liner extending circumferentially about a combustor centerline axis;

an inner liner extending circumferentially about the combustor centerline axis, a combustion chamber being defined between the outer liner and the inner liner;

a dome assembly extending between the outer liner and the inner liner; and a plurality of mixer assemblies arranged in the dome assembly, wherein at least one of the outer liner and the inner liner includes;

(a) a downstream liner portion comprising a downstream liner outer shell;

(b) an upstream liner portion comprising:

(i) an upstream liner outer shell extending circumferentially about the combustor centerline axis; and (ii) at least one upstream liner heat shield panel connected to the upstream liner outer shell, an upstream liner baffle cavity defined between the upstream liner outer shell and the at least one upstream liner heat shield panel, the upstream liner outer shell including at least one upstream liner outer shell cooling opening therethrough for providing a flow of compressed air to the upstream liner baffle cavity, and the at least one upstream liner heat shield panel including at least one slot heat shield panel cooling opening extending in a circumferential direction with respect to a combustor centerline axis, and the at least one slot heat shield panel cooling opening extending through the at least one upstream liner heat shield panel at a downstream end of the at least one upstream liner heat shield panel; and (c) at least one planar fence extending in the circumferential direction across a downstream side of the at least one slot heat shield panel cooling opening and extending beyond a hot side surface of the at least one upstream liner heat shield panel into the combustion chamber, and wherein the at least one slot heat shield panel cooling opening is arranged through the at least one upstream liner heat shield panel to provide a flow of the compressed air therethrough in a substantially radial direction with respect to the combustor centerline axis from the upstream liner baffle cavity for cooling of the at least one upstream liner heat shield panel and for providing at least partial dilution of combustion gases within the combustion chamber, and wherein the at least one planar fence is connected to one of the upstream liner outer shell or the downstream liner outer shell.

17. The gas turbine according to claim 16, wherein the at least one upstream liner heat shield panel comprises a plurality of upstream liner heat shield panels, and respective ones of the plurality of upstream liner heat shield panels are arranged circumferentially to correspond with respective ones of the plurality of mixer assemblies.

18. The gas turbine according to claim 16, wherein the at least one slot heat shield panel cooling opening comprises a plurality of slot heat shield panel cooling openings.

* * * * *